US010602269B2

(12) United States Patent
Cox

(10) Patent No.: US 10,602,269 B2
(45) **Date of Patent: *Mar. 24, 2020**

(54) THROWABLE MICROPHONE

(71) Applicant: PeeQ Technologies, LLC

(72) Inventor: Shane Cox, Cary, NC (US)

(73) Assignee: Peeq Technologies, LLC, St. George, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/921,642

(22) Filed: Mar. 14, 2018

(65) Prior Publication Data

US 2018/0206035 A1 Jul. 19, 2018

Related U.S. Application Data

(63) Continuation of application No. 15/158,446, filed on May 18, 2016, now Pat. No. 10,075,788.

(60) Provisional application No. 62/163,217, filed on May 18, 2015.

(51) Int. Cl.
*H04R 3/00* (2006.01)
*H04R 1/04* (2006.01)

(52) U.S. Cl.
CPC ..... *H04R 3/007* (2013.01); *H04R 1/04* (2013.01); *H04R 2420/07* (2013.01)

(58) Field of Classification Search
CPC ..... H04R 3/007; H04R 1/04; H04R 2420/07
See application file for complete search history.

(56) References Cited

U.S. PATENT DOCUMENTS

| | | | | |
|---|---|---|---|---|
| 8,989,420 | B1 * | 3/2015 | Hamer | H04R 1/02 381/122 |
| 8,989,429 | B2 | 3/2015 | Hamer | |
| 2003/0011706 | A1 * | 1/2003 | Chang | G08B 13/19619 348/375 |
| 2006/0183576 | A1 | 8/2006 | Lindsey | |
| 2011/0045812 | A1 | 2/2011 | Kim | |
| 2013/0315108 | A1 | 11/2013 | Linder | |
| 2014/0274218 | A1 * | 9/2014 | Kadiwala | H04M 1/6041 455/570 |
| 2014/0328488 | A1 | 11/2014 | Caballero | |
| 2015/0289074 | A1 * | 10/2015 | Kauppila | H04R 1/406 381/58 |

* cited by examiner

*Primary Examiner* — Ping Lee

(57) ABSTRACT

Some embodiments of the invention include a throwable microphone device. The throwable microphone device may comprise a housing. The throwable microphone device may include a microphone, a communication unit, a motion sensor, an orientation sensor, and a processor disposed within the housing. In some embodiments, the microphone may receive sound waves and generate a corresponding electrical audio signal. The communication unit may wirelessly transmit at least a portion of the electrical audio signals. The motion sensor may detect changes in acceleration of the throwable microphone device. The orientation sensor may detect changes in orientation of the throwable microphone device. The processor may be electrically coupled with the microphone, the communication unit, the motion sensor, and the orientation sensor. The processor may mute the throwable microphone device in response to data from the motion sensor and may also unmute the throwable microphone device in response to data from the orientation sensor.

13 Claims, 14 Drawing Sheets

THROWABLE MICROPHONE

FIELD

This disclosure relates generally to transceivers, including transmitters and receivers, in particular microphones that facilitate conversion of sound to electrical signals that may find applications in public halls, conference rooms, classrooms, etc.

BACKGROUND

Classrooms, large conference rooms, often require the participation of a number of people in the ongoing presentation or activity. Using microphones and speakers makes it easier for people sitting throughout the room, to be able to clearly present their points and/or speech, while making it easier for the rest to hear.

SUMMARY

Some embodiments of the invention may include a throwable microphone device. The throwable microphone device may comprise a housing that may include a microphone that may be disposed in the housing, which may receive sound waves and generate a corresponding electrical audio signal. The throwable microphone device may also comprise a communication unit, disposed in the housing that may wirelessly transmit at least a portion of the electrical audio signals. The throwable microphone device may comprise a motion sensor, disposed in the housing that may detect changes in acceleration of the throwable microphone device. The throwable microphone device may comprise an orientation sensor, disposed in the housing that may detect changes in orientation of the throwable microphone device. The throwable microphone device may comprise a processor, disposed in the housing, that may be electrically coupled with the microphone, the communication unit, the motion sensor, and the orientation sensor, and the processor may mute the throwable microphone device in response to data from the motion sensor and may also unmute the throwable microphone device in response to data from the orientation sensor.

In some embodiments, the housing of the throwable microphone device may comprise at least one material selected from the group consisting of soft shell, foam, fleece, polyester, cotton, rubber, nylon, leather, and padding. In some embodiments, the housing may include a flat portion, and wherein the microphone is disposed proximate to the flat portion of the throwable microphone.

In some embodiments, the motion sensor within the throwable microphone device may comprise an accelerometer, and the orientation sensor within the throwable microphone device comprises a gyroscope.

In some embodiments, the muting of the throwable microphone device may comprise switching "off" of the microphone; not transmitting the electrical audio signals from the transmitter; or, transmitting a mute signal from the transmitter.

In some embodiments, the unmuting of the throwable microphone device may comprise switching 'on' of the microphone; re-transmitting the electrical audio signals from the transmitter; or, transmitting an unmute signal from the transmitter.

Some embodiments of the invention may include a method of muting and unmuting a throwable microphone device based on signals from a motion sensor disposed within the throwable microphone device and an orientation sensor disposed within the throwable microphone device. In some embodiments, the method may comprise receiving sound waves at a microphone disposed within the throwable microphone device. Electrical audio signals corresponding to the sound waves, may then be wirelessly transmitted via a transmitter disposed within the throwable microphone device. An acceleration signal from the motion sensor may be received at a processor disposed within the throwable microphone device. The throwable microphone device may be muted, in the event the acceleration signal exceeds a first threshold. The processor may receive a spin signal from an orientation sensor, and the throwable microphone device may be unmuted, in the event the spin signal is lower than a second threshold.

In some embodiments, the motion sensor used in the method of muting and unmuting the throwable microphone device, may comprise an accelerometer, and the orientation sensor used in the method of muting and unmuting the throwable microphone device may comprise a gyroscope.

In some embodiments, the spin signal may be represented based on the orientation of the throwable microphone device along a rotational axis, and wherein the spin signal may also be determined based on the presence or absence of a rotational force on the throwable microphone device.

In some embodiments, the muting of the throwable microphone device may comprise switching "off" of the microphone; not transmitting the electrical audio signals from the transmitter; or, transmitting a mute signal from the transmitter.

In some embodiments, the unmuting of the throwable microphone device may comprise switching 'on' of the microphone; re-transmitting the electrical audio signals from the transmitter; or, transmitting an unmute signal from the transmitter.

Some embodiments of the invention may include a throwable microphone device. The throwable microphone device may comprise a microphone that may receive sound waves; a transmitter that may transmit electrical audio signals corresponding to the sound waves to a receiver; a sensor that may detect any motion of the throwable microphone device; and a processor. In some embodiments, the processor may be configured to receive at the processor a first sensor signal; determine based on the first sensor signal, that the microphone is facing downward; set the throwable microphone device to a muted state; receive at the processor a second sensor signal; determine based on the second sensor signal that the microphone is facing upward; and set the throwable microphone device to an unmuted state.

In some embodiments, the sensor within the throwable microphone device may include an accelerometer that may measure the acceleration of the throwable microphone device with respect to gravity along an axis and providing an acceleration value.

In some embodiments, the processor, within the throwable microphone device, may determine whether the throwable microphone device is facing downward or upward based on whether the acceleration value of the throwable microphone device is below or above a threshold value.

In some embodiments, when the processor may receive the sensor signal and may detect that the motion or average motion of the throwable microphone device is below a threshold, the processor may determine that the throwable microphone device is in a still state.

In some embodiments, the throwable microphone device may enter the auto-mute state when the first sensor signal is below a threshold value continually for a given period of time.

In some embodiments, the processor may be configured to determine that the sensor signal corresponds with a shaking action, and may unmute the throwable microphone device, in the event the sensor signal comprising an acceleration corresponding to the shaking action is above a threshold.

In some embodiments, the muting of the throwable microphone device may include switching "off" of the microphone; not transmitting the electrical audio signals from the transmitter; or, transmitting a mute signal from the transmitter.

In some embodiments, the unmuting of the throwable microphone device may comprise switching 'on' of the microphone; re-transmitting the electrical audio signals from the transmitter; or, transmitting an unmute signal from the transmitter.

These illustrative embodiments are mentioned not to limit or define the disclosure, but to provide examples to aid understanding thereof. Additional embodiments are discussed in the Detailed Description, and further description is provided there. Advantages offered by one or more of the various embodiments may be further understood by examining this specification or by practicing one or more embodiments presented.

BRIEF DESCRIPTION OF THE FIGURES

These and other features, aspects, and advantages of the present disclosure are better understood when the following Detailed Description is read with reference to the accompanying drawings.

DETAILED DESCRIPTION

Systems and methods are disclosed for a throwable microphone device. The throwable microphone device may be configured to analyze different types of motion and different positioning to determine a current state of the throwable microphone device, and in response set the throwable microphone device into a different state (e.g., a muted or an unmuted state). In some embodiments, a system may include a communication unit, a microcontroller unit, a microphone, an orientation sensor, a motion sensor, and/or a camera unit disposed within a housing.

Some embodiments include a throwable microphone device that may include a transmitter device (e.g., that is disposed within the throwable microphone device) and a receiver device (e.g., placed external relative to the throwable microphone device). In some embodiments, the transmitter device and the receiver device may be capable of transmitting and receiving an audio signal, respectively. In some embodiments, the transmitter device and the receiver device may be wireless. In some embodiments, the transmitter device may be inserted into the throwable microphone device and/or device. In some embodiments, the transmitter device may include a camera disposed within the throwable microphone device. In some embodiments, the throwable microphone device may be a wireless system and/or device.

Figure 1A:
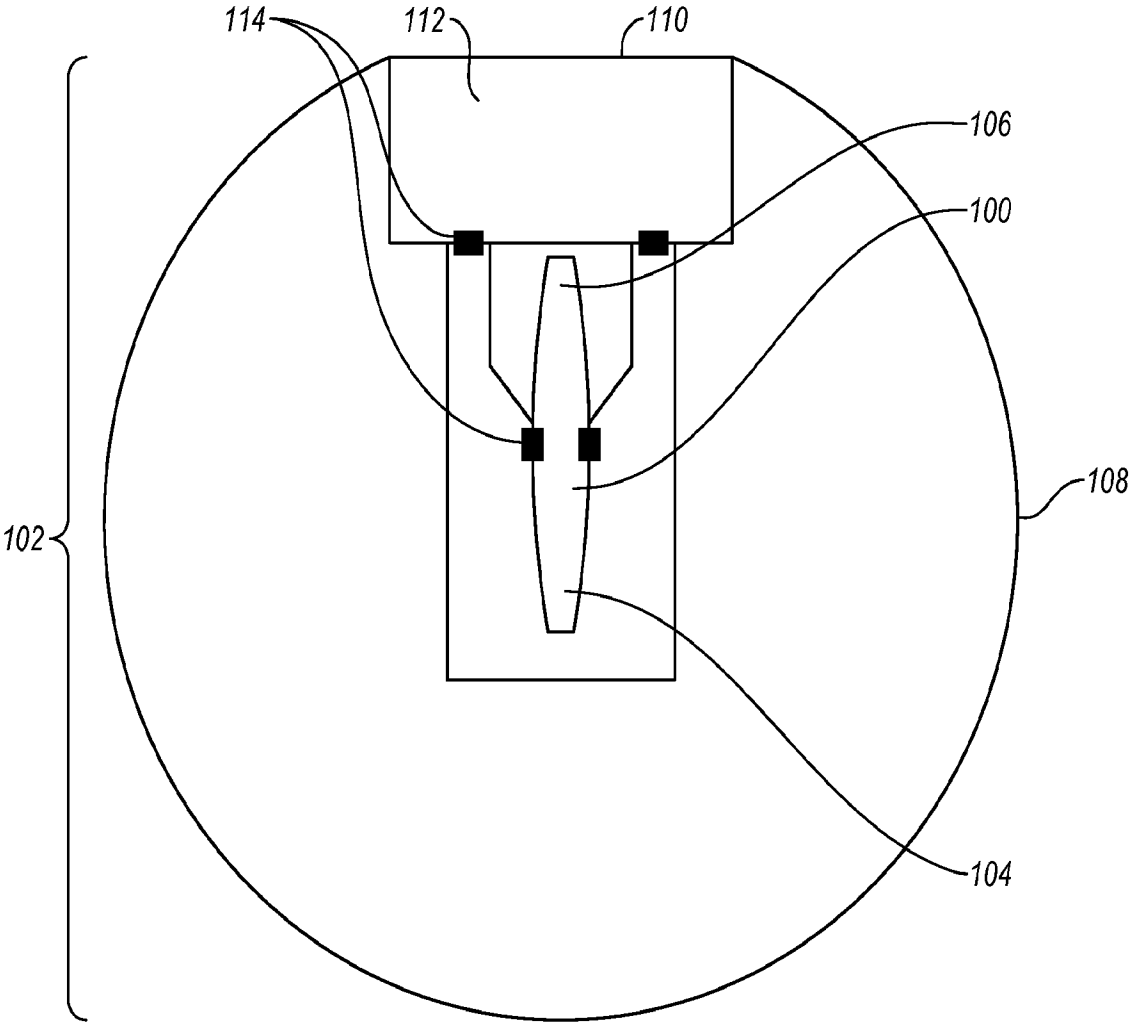
FIG. 1A is a cross sectional view of an example transmitter inserted in an example throwable microphone device.

FIG. 1A illustrates a cross sectional view of an example wireless microphone device 100 inserted in an example throwable microphone device 102, according to some embodiments. In some embodiments, when the wireless microphone device 100 is inserted in the throwable microphone device 102, the wireless microphone device 100 may be disposed centrally within the throwable microphone device 102. In some embodiments, the throwable microphone device 102 may include a flat portion 110. In some embodiments, when the wireless microphone device 100 is inserted in the throwable microphone device 102, the wireless microphone device 100 may be oriented vertically relative to the flat portion 110, within the throwable microphone device 102. In some embodiments, when the wireless microphone device 100 is inserted in the throwable microphone device 102, a first end or portion 104 of the wireless microphone device 100 may be disposed at least proximate a middle or center of the throwable microphone device 102. In some embodiments, a second end or portion 106 of the wireless microphone device 100 may be disposed at least proximate an outer surface 108 of the throwable microphone device 102. In some embodiments, the second end portion 106 of the wireless microphone device 100 may be disposed proximate to the flat portion 110 of the throwable microphone device 102. In some embodiments, a microphone may be disposed on the second portion or at least proximate an outer surface of the throwable microphone device 102 when the wireless microphone device 100 is inserted in the throwable microphone device 102, which may allow the wireless microphone device 100 to more easily detect sound outside the throwable microphone device 102.

In some embodiments, the throwable microphone device 102 may be any shape, such as, for example, spherical, elliptical, conical, cylindrical, cubical, 3D polyhedron, and/or other 3D polygonal shapes etc. In some embodiments, the throwable microphone device 102 may include a soft shell, foam, fleece, polyester, cotton, rubber, nylon, leather, and/or padding, which may allow the throwable microphone device 102 to be thrown without damage to the wireless microphone device 100 or the person catching the throwable microphone device 102.

In some embodiments, when the flat portion 110 is facing downward or towards the ground, the throwable microphone device 102 may be situated stably on a flat surface and may not roll. In some embodiments, when the flat portion 110 of the throwable microphone device 102 is facing downward, the microphone within the wireless microphone device 100 inserted in the throwable microphone device 102 may also face downward. When the flat portion 110 of the throwable microphone device 102 is facing upward, the microphone on the wireless microphone device 100 may also face upward. In some embodiments, when the microphone is facing upward, and the throwable microphone device 102 with the wireless microphone device 100 is being held by a user, a voice of the user may be detected more easily in comparison to when the microphone is facing downward. In some embodiments, the throwable microphone device 102 may be said to be facing and/or moving in the same direction or manner as the microphone.

In some embodiments, a cap 112 may cover the wireless microphone device 100 and protect the wireless microphone device 100 within the throwable microphone device 102. In some embodiments, the cap 112 may be removed prior to insertion of the wireless microphone device 100 and replaced once the wireless microphone device 100 is inserted. In some embodiments, one or more magnets 114 may be used to secure the cap 112. In some embodiments, one or more magnets 114 may be used to secure the wireless microphone device 100 in the throwable microphone device 102.

Figure 1B:
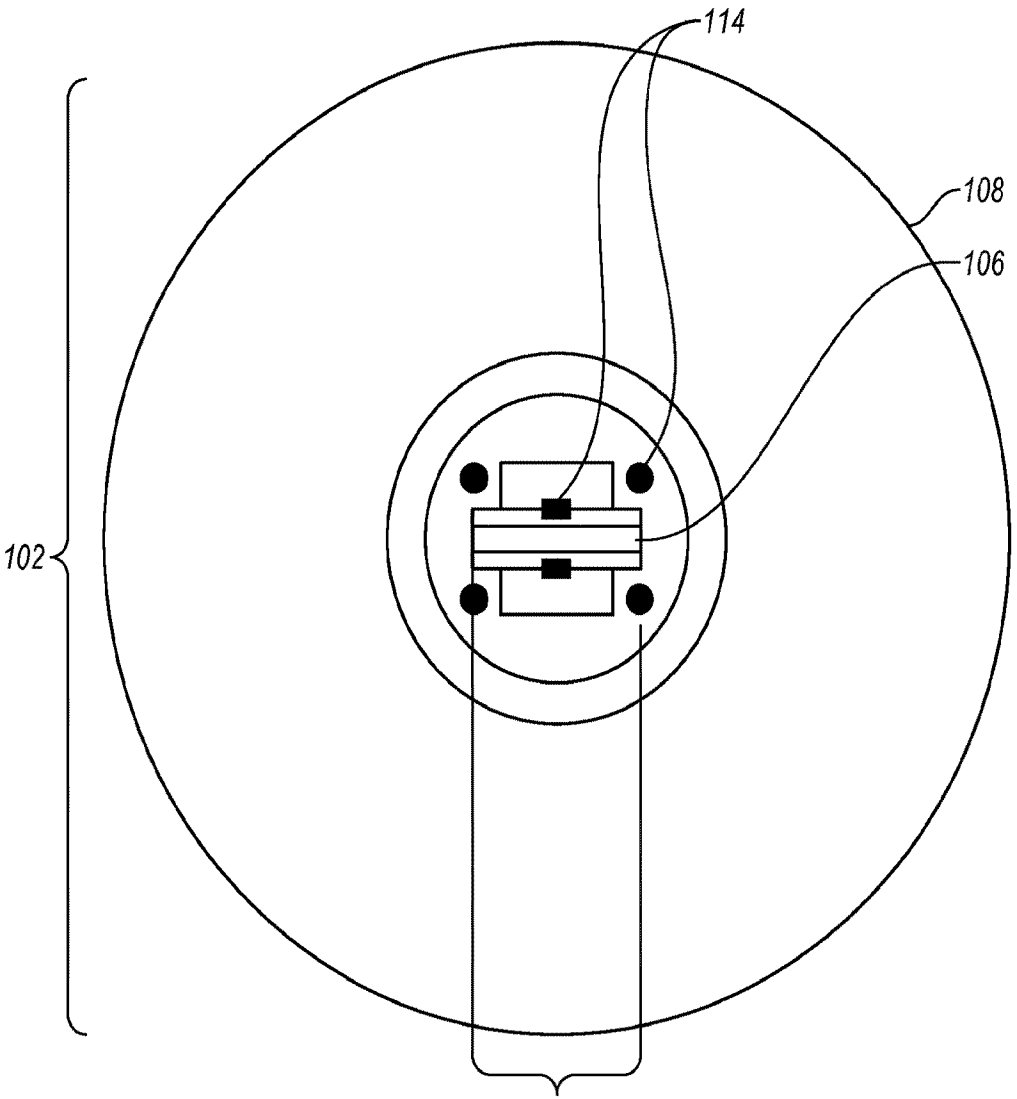
FIG. 1B is a top view of a transmitter inserted in a throwable microphone device with a cap removed.

FIG. 1B is a top view of the wireless microphone device 100 inserted in the throwable microphone device 102 with the cap 112 removed.

Figure 1C:
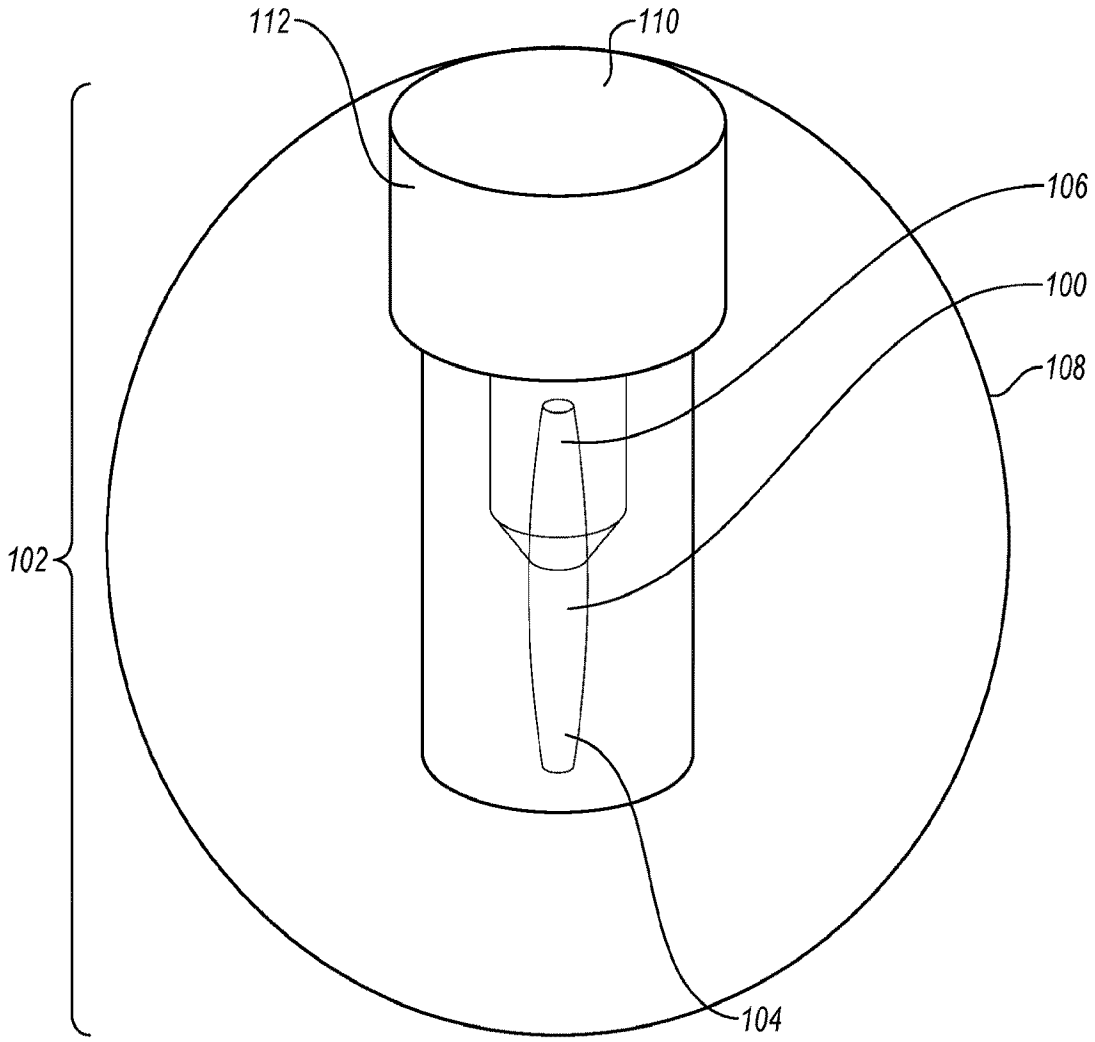
FIG. 1C is an upper perspective view of a transmitter inserted in a throwable microphone device with the cap in place.

FIG. 1C is an upper perspective view of the wireless microphone device 100 inserted in the throwable microphone device 102 with the cap 112 in place.

Figure 2:
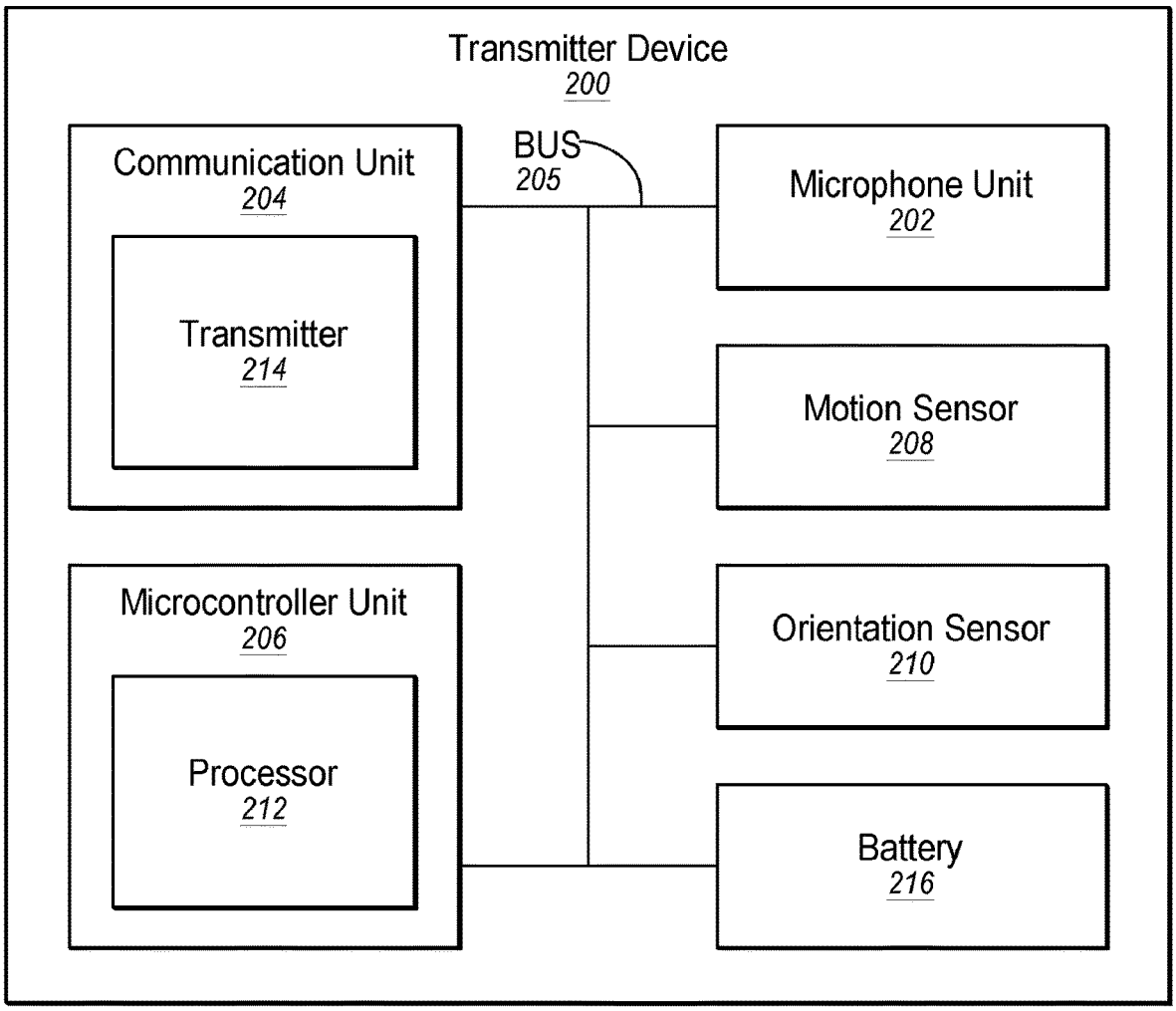
FIG. 2 is a block diagram illustrating a transmitter device of a throwable microphone device.

FIG. 2 illustrates an example throwable microphone device 200, according to some embodiments. In some embodiments, the throwable microphone device 200 may include or correspond to the throwable microphone device 102 of FIG. 1. In some embodiments, the throwable microphone device 200 may include a microphone 202, a communication unit 204, a microcontroller unit 206, a motion sensor 208, an orientation sensor 210 and/or a battery 216. In some embodiments, the motion sensor and the orientation sensor may be combined in a single unit or may be disposed on the same silicon die. In some embodiments, the communication unit 204 may include a transmitter 214. In some embodiments, the communication unit 204 may also include a receiver. In some embodiments, the microcontroller unit 206 may include a processor 212. In some embodiments, the microcontroller unit 206 may also include a memory, a bus architecture, various electronic components, etc. In some embodiments, the battery 216 may be a non-rechargeable battery, while in some other embodiments, the battery 216 may be a chargeable battery. In some embodiments, the components within the throwable microphone device 200 can be electrically coupled via a bus 205 (or may otherwise be in communication, as appropriate). In some embodiments, the microphone 202 may be configured to receive sound waves and produce corresponding electrical audio signals. In some embodiments, the components within the throwable microphone device 200 may be directly coupled together without a bus.

In some embodiments, the motion sensor 208 may include any sensor capable of detecting motion, such as, for example, an accelerometer. In some embodiments, the motion sensor may include any number of axes, such as, for example, three (3) axes. In some embodiments, the motion sensor 208 may be configured to detect a state of motion of the throwable microphone device 200 and provide a motion sensor signal responsive to the state of motion. For example, in response to flight of the throwable microphone device 200, the motion sensor 208 may provide a motion sensor signal to the processor 212 that indicates acceleration of the motion sensor 208. The processor 212 may determine that the throwable microphone device 200 has been thrown when the processor 212 detects an acceleration of the motion sensor 208 above a threshold value based on the motion sensor signal.

As another example, in response to a tap and/or a double tap on the throwable microphone device 200, the motion sensor 208 may provide a motion sensor signal to the processor 212 that indicates acceleration of the motion sensor 208. The processor 212 may determine that the throwable microphone device 200 has received the tap and/or the double tap when the processor 212 detects an acceleration of the motion sensor 208 above a threshold value based on the motion detected by the motion sensor.

As a further example, in response to the throwable microphone device 200 being in a still state, the motion sensor 208 may provide a motion sensor signal to the processor 212 that indicates motion or average motion of the motion sensor 208 is less than a threshold value. The processor 212 may determine that the throwable microphone device 200 is in the still state when the processor 212 detects that the motion or the average motion of the throwable microphone device is less than a threshold value based on the motion sensor signal.

In some embodiments, when the throwable microphone device 200 is in the still state it may not move for a period of time and/or the motion or average motion of the throwable microphone device 200 may be less than a threshold value. In some embodiments, the processor 212 may be configured to receive a motion sensor signal from the motion sensor 208 and determine the state of motion of the throwable microphone device 200 based on the motion sensor signal. The state of motion may include, for example, still, a throw, a single tap, or a double tap. In some embodiments, the processor 212 may be configured to define a particular state of motion based on a value of a motion sensor signal or a range of values of the motion sensor signal.

In some embodiments, the orientation sensor 210 may include any sensor capable of determining position or orientation, such as, for example, a gyroscope. In some embodiments, the orientation sensor 210 may include any number of axes, such as, for example, three (3) axes. In some embodiments, the motion sensor 208 and the orientation sensor 210 may be combined in a single unit or may be disposed on the same silicon die. In some embodiments, the motion sensor 208 and the orientation sensor 210 may be combined a single sensor device.

In some embodiments, the motion sensor 208 may be configured to detect a position of the microphone 202 and provide a motion sensor signal responsive to the position. For example, in response to the microphone 202 facing upward, the motion sensor 208 may provide a motion sensor signal to the processor 212. The processor 212 may determine that the microphone 202 is facing upward based on the motion sensor signal. As another example, in response to the throwable microphone device 200 facing downward, the motion sensor 208 may provide a different orientation sensor signal to the processor 212. The processor 212 may determine that the microphone 202 is facing downward based on the orientation sensor signal.

In some embodiments, when the microphone 202 faces upwards, the throwable microphone device 200 may also be said to be facing upwards. In some embodiments, when the microphone 202 faces downwards, the throwable microphone device 200 may also be said to be facing downwards. Thus, in some embodiments, a motion sensor signal may indicate the microphone 202 is facing upward or downward by indicating the throwable microphone device 200 is facing upward or downward, respectively.

In some embodiments, the processor 212 may be configured to receive an orientation sensor signal from the orientation sensor 210 and determine the position of the microphone 202 based on the orientation sensor signal. In some embodiments, the processor 212 may be configured to define a particular position based on the orientation sensor signal.

In some embodiments, the microphone 202 may be disposed in a portion of the throwable microphone device 200, which may include or correspond to the second portion 106 of the wireless microphone device 100 of FIG. 1. In some embodiments, the microphone 202 may be disposed at least proximate a flat portion of the throwable microphone device, which may correspond to the flat portion 110 of the throwable microphone device 102 of FIG. 1.

In some embodiments, the communication unit 204 may allow the throwable microphone device 200 to communicate with a receiver device. In some embodiments, the communication unit 204 may include a transmitter 214. In some embodiments, the communication unit 204 may also include a receiver. In some embodiments, the transmitter 214 may include an analog radio transmitter. In some embodiments, the transmitter 214 may communicate digital or analog audio signals over the analog radio. In some embodiments, the transmitter 214 may wirelessly transmit radio signals to the receiver device. In some embodiments, the transmitter 214 may include a Bluetooth®, WLAN, Wi-Fi, WiMAX, Zigbee, or other wireless device to send radio signals to the receiver device. In some embodiments, the receiver device may include one or more speakers or may be coupled with one or more speakers.

In some embodiments, in response to receipt of one or more sensor signals by the processor 212, the throwable microphone device 200 may be changed from a muted state to an unmuted state, or alternatively, from the unmuted state to the muted state. In some embodiments, the processor 212 may be configured to change the state of communication of the transmitter by changing a state of communication of the microphone 202 and/or the communication unit 204. For example, the throwable microphone device 200 may be changed to the muted state by changing the microphone 202 and/or the communication unit 204 to the muted state. In some embodiments, the microphone 202 may be changed to the muted state using a power button on the throwable microphone device 200 or on the receiver device. In some embodiments, when the throwable microphone device 200 is in the unmuted state, the throwable microphone device 200 may send audio to the receiver device via the communication unit 204. In some embodiments, when the microphone 202 and the communication unit 204 are in the unmuted state, the receiver device may receive a signal from the throwable microphone device 200 to enable sound production.

In some embodiments, muting the throwable microphone device may comprise switching "off" of the microphone, wherein the microphone 202 may not receive any sound waves and the communication unit 204 may not transmit any audio signals. In some embodiments, muting of the throwable microphone device may include a state of the throwable microphone device, wherein the microphone within the throwable microphone device may receive the sound waves but may not transmit the corresponding electrical audio signal. In some embodiments, muting of the throwable microphone device may include a state of the throwable microphone device, wherein the microphone within the throwable microphone device may not receive the sound waves. In some embodiments, the switching "off" of the throwable microphone device 200 may be analogous to switching off the power button on the throwable microphone device 200.

In some embodiments, muting the throwable microphone device 200 may comprise not transmitting the electrical audio signals from the transmitter. In some embodiments, the throwable microphone device 200 may receive the sound waves, and may convert the sound waves into electrical audio signals, but may not transmit the electrical audio signals from the transmitter, while in the muted state. In some embodiments, the throwable microphone device 200 may store the electrical audio signals in a memory till the phone stays in a muted state.

In some embodiments, muting the throwable microphone device 200 may comprise transmitting a mute signal from the transmitter. In some embodiments, the throwable microphone device 200 may receive the sound waves, but the processor 212 may only transmit a low energy level signal, and may not send the electrical audio signal.

In some embodiments, unmuting the throwable microphone device 200 may comprise switching "on" of the microphone. In some embodiments, the switching "on" of the throwable microphone device 200 may be analogous to switching on the power button on the throwable microphone device 200.

In some embodiments, unmuting the throwable microphone device 200 may comprise re-transmitting the electrical audio signals from the transmitter. In some embodiments, the throwable microphone device 200 may receive the sound waves, and may convert the sound waves into electrical audio signals and may store them in a memory till the throwable microphone device 200 is in a muted state. In some embodiments, in the unmuted state, the stored electrical audio signals may be transmitted. In some other embodiments, the throwable microphone device 200 may just start transmitting electrical audio signals of currently received sound waves.

In some embodiments, unmuting the throwable microphone device 200 may comprise transmitting an unmute signal from the transmitter. In some embodiments, the throwable microphone device 200 may transmit a high energy level signal, while in other embodiments, the throwable microphone device 200 may start sending electrical audio signals of the sound waves being received.

Figure 3:
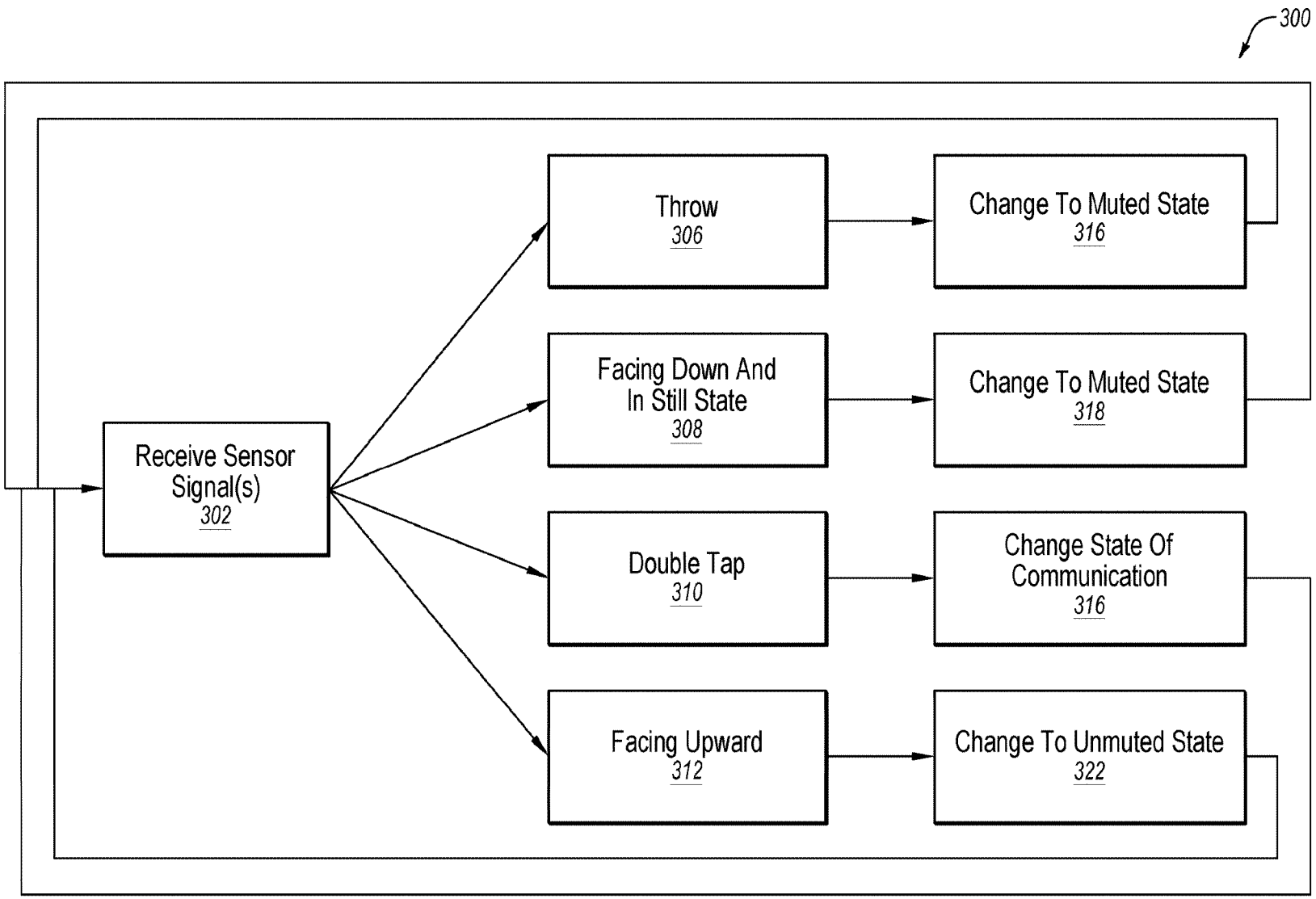
FIG. 3 is a flowchart of an example method of operation of the throwable microphone device.

FIG. 3 is an example flow diagram of a method 300 of operation of a throwable microphone device and/or system. In some embodiments, the throwable microphone device and/or system may include or correspond to the throwable microphone device and/or system 100 of FIG. 1 or the throwable microphone device 200 of FIG. 2. In some embodiments, the method 300 may be implemented, in whole or in part, by a processor. The processor may include or correspond to the processor 212 of FIG. 2. The method 300 may begin at block 302.

At block 302, one or more sensor signals may be received. For example, a motion sensor signal from a motion sensor and/or an orientation sensor signal from an orientation sensor may be received.

At block 306, it may be determined, based on the sensor signal received at block 302, whether the throwable microphone device is being thrown. In some embodiments, it may be determined that the transmitter is being thrown based on a sensor signal that indicates an acceleration of the motion sensor. For example, the processor may determine that the throwable microphone device has been thrown when the processor detects an acceleration above a threshold value. Block 306 may be followed by block 316.

At block 316, in response to determining that the throwable microphone device is being thrown, the throwable microphone device may be changed to the muted state (assuming the throwable microphone device is not already in the muted state, in which case the throwable microphone device would stay in the muted state in response to determining that the throwable microphone device is being thrown). In some embodiments, the throwable microphone device may remain in the muted state during, until, and/or after a catch by a user. Block 316 may be followed by block 302. Thus, in some embodiments, the transmitter may remain in the muted state after the throw until another sensor signal, such as, for example, a signal indicating a double tap, a signal indicating that the microphone has been caught, or a signal indicating the microphone is facing upward, is received that may change the state of communication of the throwable microphone device.

At block 308, it may be determined whether the microphone is facing down and/or the throwable microphone device is in a still state. In some embodiments, it may be determined that the microphone is facing down while the throwable microphone device is in the still state in response to simultaneous receipt of an orientation sensor signal from an orientation sensor indicating the microphone is facing down and a motion sensor signal (or lack thereof) indicating the transmitter is in the still state. For example, the period of time may include one (1), two (2), five (5), ten (10), twenty (20) seconds or any other period of time. Block 308 may be followed by block 318.

At block 318, in response to determining the microphone is facing down and/or in the still state, the throwable microphone device may be changed to the muted state (assuming the throwable microphone device is not already in the muted state, in which case the throwable microphone device would stay in the muted state in response to determining that the throwable microphone device is facing down and/or in the still state). Block 318 may be followed by block 302.

At block 310, it may be determined whether the throwable microphone device has received a double tap. In some embodiments, the double tap may occur when a user taps the throwable microphone device or the throwable microphone device two times in succession. The user may perform the double tap using, for example, a finger or a hand or by tapping the throwable microphone device on a surface. In some embodiments, a double tap may be indicated when a first motion sensor signal indicating a tap is followed by a second motion sensor signal indicating another tap. For example, the processor may determine that a double tap has occurred in response to detecting two successive peaks in the motion data separated by a period of time. In some embodiments, it may be determined that the throwable microphone device has received a double tap when the second motion sensor signal follows the first motion sensor signal by a period of time. The period of time may be a fraction of one (1) second, one (1) second, two (2) seconds, or any other period of time. Block 310 may be followed by block 320. At block 320, in response to determining the throwable microphone device has received a double tap, the state of communication of the throwable microphone device may be changed. For example, the throwable microphone device may in the muted state and changed to the unmuted state, or the throwable microphone device may be in the unmuted state and changed to the muted state. Block 320 may be followed by block 302.

At block 312, it may be determined whether the microphone is facing upward. In some embodiments, it may be determined that the microphone is facing upward in response to receipt of an orientation sensor signal from an orientation sensor that indicates the throwable microphone device and/or microphone is facing upward. In some embodiments, it may be determined that the microphone is facing upward when the transmitter and/or microphone are facing in the upward direction for a period of time. In some embodiments, the period of time may be a fraction of one (1) second, one (1) second, two (2) seconds, or any other period of time. Block 312 may be followed by block 322.

At block 322, in response to determining the throwable microphone device is facing upward, the throwable microphone device may be changed to the unmuted state (assuming the throwable microphone device is not already in the unmuted state, in which case the throwable microphone device would stay in the unmuted state in response to determining that the throwable microphone device is facing upward). Block 322 may be followed by block 302.

Figure 4:
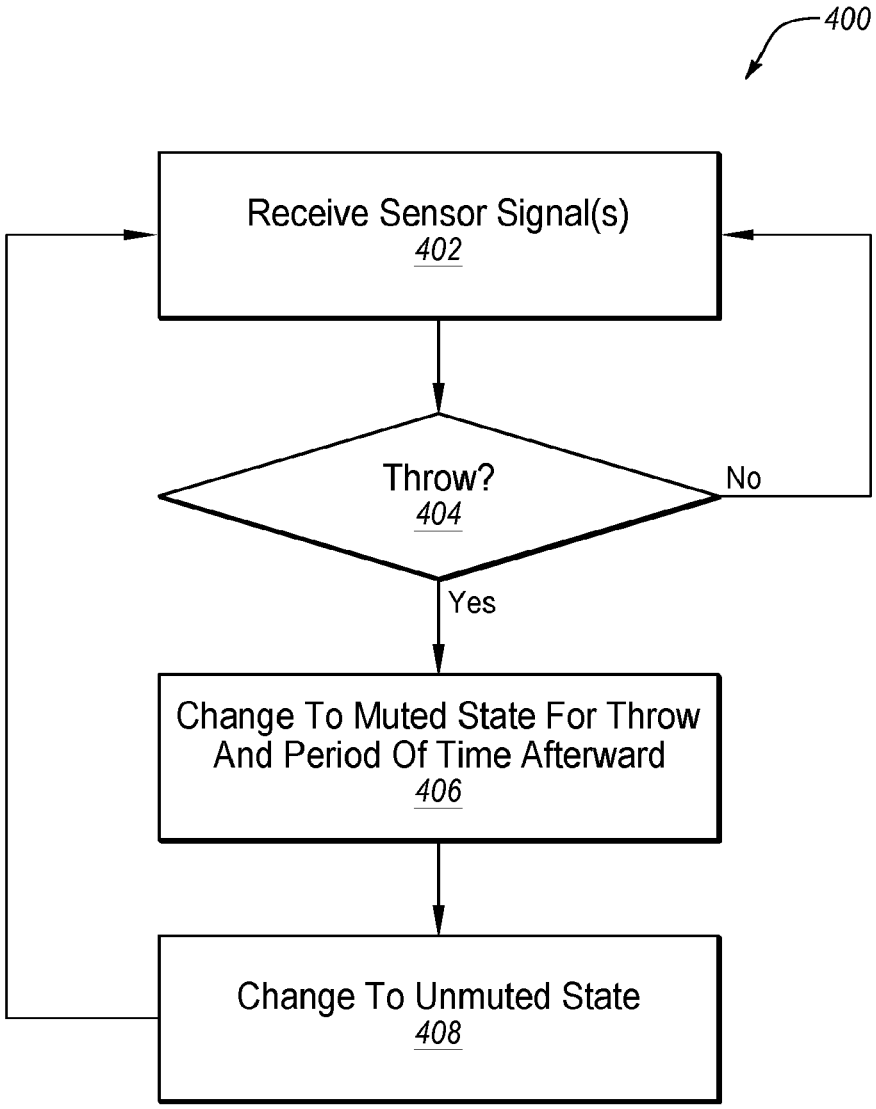
FIG. 4 is a flowchart of another example method of operation of the throwable microphone device.

FIG. 4 is an example flow diagram of a method 400 of operation of a throwable microphone device. In some embodiments, the throwable microphone device may include or correspond to the throwable microphone device 102 of FIG. 1 or the throwable microphone device 200 of FIG. 2. In some embodiments, the method 400 may be implemented, in whole or in part, by a processor such as, for example, the processor 212 of FIG. 2. The method 400 may begin at block 402.

At block 402, one or more sensor signals may be received. For example, a motion sensor signal from a motion sensor (e.g., motion sensor 208 of FIG. 2) may be received or an orientation sensor signal from an orientation sensor (e.g., orientation sensor 210 of FIG. 2) may be received. In some embodiments, the transmitter may be in either a muted or unmuted state. Block 402 may be followed by block 404.

At block 404, it may be determined whether the throwable microphone device is being thrown. It may be determined that the throwable microphone device is being thrown in response to the processor determining that the sensor signal indicates an acceleration that exceeds a threshold value. In some embodiments, an average acceleration signal may be compared with the first threshold value. In some embodiments, a peak acceleration value may be compared with the first threshold value. In some embodiments, an acceleration profile or curve may be compared with a threshold profile or curve. In some embodiments, an instantaneous acceleration value may be compared with the first threshold value. Block 404 may be followed by block 402 if it is determined that the acceleration of the throwable microphone device does not exceed the threshold value ("No" at block 404) or by block 406 if it is determined that the acceleration of the throwable microphone device exceeds the threshold value ("Yes" at block 404).

If it is determined that the acceleration of the throwable microphone device does not exceed the threshold value ("No" at block 404), the sensor signal received at block 402 may indicate another state of motion or a position, such as for example, a double tap or the microphone facing upward, which may change the state of communication of the throwable microphone device.

If the processor determines that the throwable microphone device has been thrown, at block 406, the throwable microphone device may be changed to a muted state during the throw and/or for a period of time afterward. The period of time may be a fraction of one (1) second, one (1) second, two (2) seconds, or any other period of time. In some embodiments, the throwable microphone device may remain in the muted state until the processor determines that the sensor signal indicates that the transmitter has been caught such as, for example, a sensor signal indicating a change in acceleration above a threshold value. In some embodiments, the throwable microphone device may remain in the muted state until the processor determines that the throwable microphone device is no longer in a spinning motion, such as, for example an orientation value of the throwable microphone device is zero, or may be below a threshold.

In some embodiments, the throwable microphone device may remain in the muted state while the transmitter is no longer being thrown to eliminate handling noises that may result from a catch or orienting the throwable microphone device after a catch. In some embodiments, muting of the throwable microphone device may include switching 'off' of the throwable microphone device. In some other embodiments, muting of the throwable microphone device may include turning the throwable microphone device to a sleep or standby mode, wherein the throwable microphone device uses minimum power. In some embodiments, the muting of the throwable microphone device may include turning the throwable microphone device to a hibernate mode, wherein the throwable microphone device may use zero power. Block 406 may be followed by block 408.

In some embodiments, muting the throwable microphone device may comprise switching "off" of a microphone, within the throwable microphone device, wherein the microphone may not receive any sound waves, and a communication unit within the throwable microphone device, may not transmit any audio signals. In some embodiments, muting of the throwable microphone device may include a state of the throwable microphone device, wherein the microphone within the throwable microphone device may receive the sound waves but may not transmit the corresponding electrical audio signal. In some embodiments, muting of the throwable microphone device may include a state of the throwable microphone device, wherein the microphone within the throwable microphone device may not receive the sound waves. In some embodiments, the switching "off" of the throwable microphone device may be analogous to switching off the power button on the throwable microphone device.

In some embodiments, muting the throwable microphone device may comprise not transmitting the electrical audio signals from the transmitter. In some embodiments, the throwable microphone device may receive the sound waves, and may convert the sound waves into electrical audio signals, but may not transmit the electrical audio signals from the transmitter, while in the muted state. In some embodiments, the throwable microphone device may store the electrical audio signals in a memory till the phone stays in a muted state.

In some embodiments, muting the throwable microphone device may comprise transmitting a mute signal from the transmitter. In some embodiments, the throwable microphone device may receive the sound waves, but a processor disposed within the throwable microphone device, may only transmit a low energy level signal, and may not send the electrical audio signal.

At block 408, in response to the period of time after the throw being complete or another indication that the throwable microphone device should be unmuted, the throwable microphone device may be changed to the unmuted state. In some embodiments, unmuting of the throwable microphone device may include switching 'on' of the throwable microphone device from an 'off' state. In some embodiments, unmuting of the throwable microphone device may include switching 'on' of the throwable microphone device from a sleep state or a hibernate state. In some embodiments, unmuting of the throwable microphone device may include receiving the sound waves into the microphone and transmitting the corresponding electrical audio signals to a receiver unit. Block 408 may be followed by block 402.

In some embodiments, unmuting the throwable microphone device may comprise switching "on" of the microphone. In some embodiments, unmuting of the throwable microphone device may include a state of the throwable microphone device, wherein the microphone within the throwable microphone device may receive the sound waves and may transmit the corresponding electrical audio signal. In some embodiments, the switching "on" of the throwable microphone device may be analogous to switching on the power button on the throwable microphone device.

In some embodiments, unmuting the throwable microphone device may comprise re-transmitting the electrical audio signals from the transmitter. In some embodiments, the throwable microphone device may receive the sound waves, and may convert the sound waves into electrical audio signals and may store them in a memory till the throwable microphone device is in a muted state. In some embodiments, in the unmuted state, the stored electrical audio signals may be transmitted. In some other embodiments, the throwable microphone device may just start transmitting electrical audio signals of currently received sound waves.

In some embodiments, unmuting the throwable microphone device may comprise transmitting an unmute signal from the transmitter. In some embodiments, the throwable microphone device may transmit a high energy level signal, while in other embodiments, the throwable microphone device may start sending electrical audio signals of the sound waves being received.

Each of the various blocks (or steps) illustrated in FIG. 4 may or may not be present. For example, one or more blocks may be skipped or may not be executed. In some embodiments, additional blocks may be implemented.

Figure 5:
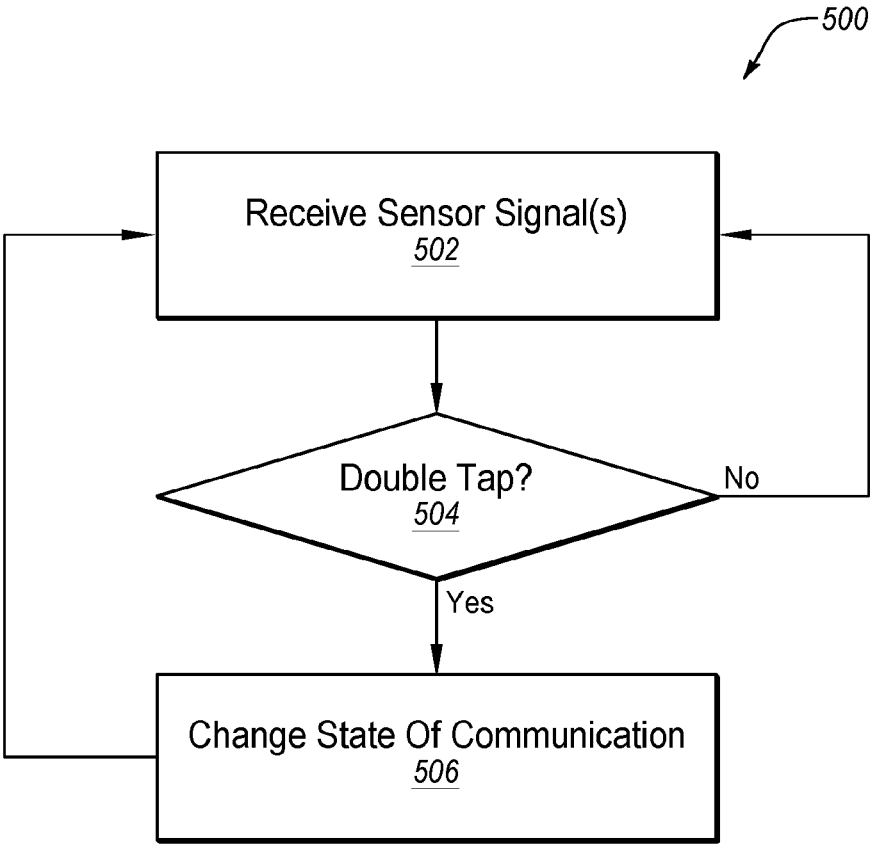
FIG. 5 is a flowchart of another example method of operation of the throwable microphone device.

FIG. 5 is an example flow diagram of a method 500 of operation of a throwable microphone device. In some embodiments, the throwable microphone device may include or correspond to the throwable microphone device 102 of FIG. 1 or the throwable microphone device 200 of FIG. 2. In some embodiments, the method 400 may be implemented, in whole or in part, by a processor. The processor may include or correspond to the processor 212 of FIG. 2. The method 500 may begin at block 502.

At block 502, one or more sensor signals may be received at the processor from a sensor. For example, a motion sensor signal from a motion sensor may be received at the processor and/or an orientation sensor signal from an orientation sensor may be received at the processor. In some embodiments, the motion sensor and the orientation sensor may be combined in a single unit or may be disposed on the same silicon die. Block 502 may be followed by block 504.

At block 504, it may be determined if the throwable microphone device has received a double tap. In some embodiments, the double tap may occur when a user taps the throwable microphone device or the throwable microphone device two times in succession. The user may perform the double tap using, for example, a finger or a hand or by tapping the throwable microphone device on a surface. In some embodiments, a double tap may be indicated when a first motion sensor signal indicating a tap is followed by a second motion sensor signal indicating another tap. In some embodiments, it may be determined that the throwable microphone device has received a double tap when the second motion sensor signal follows the first motion sensor signal by a period of time. The first motion sensor signal may indicate an acceleration that exceeds a threshold value, and the second motion sensor signal may indicate a second acceleration that exceeds the threshold value. In some embodiments, the first and second acceleration may be equal to each other. The period of time may be set as a fraction of one (1) second, one (1) second, two (2) seconds, or any other period of time. Block 504 may be followed by block 506. Block 504 may be followed by block 506 if it is determined that the acceleration of the throwable microphone device has not received a double tap ("No" at block 504) or by block 506 if it is determined that the throwable microphone device has received a double tap ("Yes" at block 504).

At block 506, in response to determining the throwable microphone device has received a double tap, the throwable microphone device may be changed from one state of communication to another. For example, the throwable microphone device may be changed from the muted state to the unmuted state. Alternatively, in some embodiments, the throwable microphone device may be changed from the unmuted state to the muted state.

Each of the various blocks (or steps) illustrated in FIG. 5 may or may not be present. For example, one or more blocks may be skipped or may not be executed. In some embodiments, additional blocks may be implemented.

Figure 6:
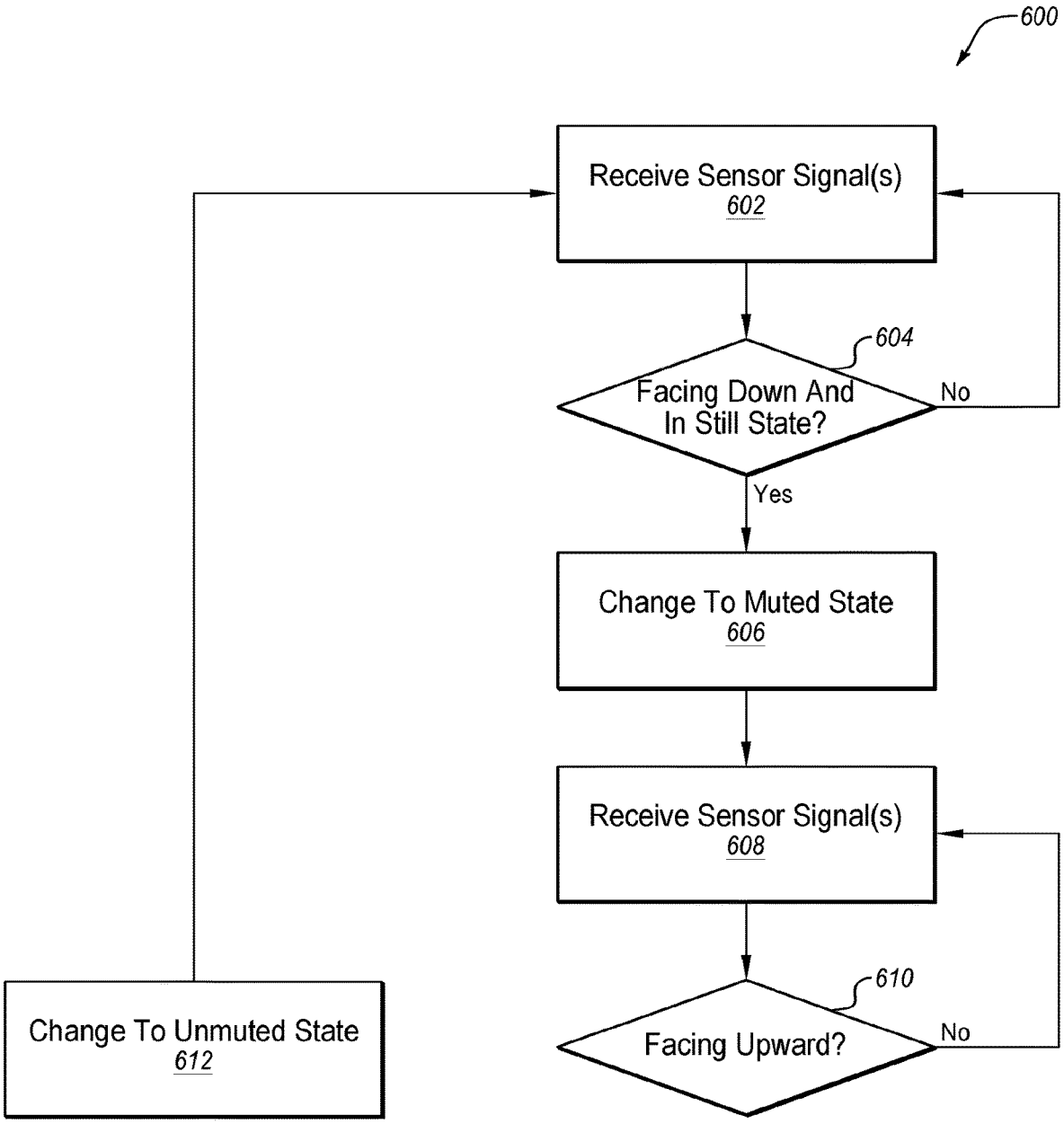
FIG. 6 is a flowchart of another example method of operation of the transmitter device of a throwable microphone device.

FIG. 6 is an example flow diagram of a method 600 of operation of a throwable microphone device. In some embodiments, the throwable microphone device may include or correspond to the throwable microphone device 102 of FIG. 1 or the throwable microphone device 200 of FIG. 2. In some embodiments, the method 600 may be implemented, in whole or in part, by a processor. The processor may include or correspond to the processor 212 of FIG. 2. The method 600 may begin at block 602.

At block 602, one or more sensor signals may be received at the processor from a sensor. For example, a motion sensor signal from a motion sensor and/or an orientation sensor signal from an orientation sensor may be received. In some embodiments, the transmitter may be in either the unmuted or the muted state when the sensor signals are received. Block 602 may be followed by block 604.

At block 604, it may be determined whether the microphone is facing down while the throwable microphone device is in the still state. In some embodiments, it may be determined that the microphone is facing down and/or the throwable microphone device is in the still state in response to simultaneous receipt of an orientation sensor signal from an orientation sensor that indicates the microphone is facing down and/or a motion sensor signal (or lack thereof) that indicates the transmitter is in the still state. In some embodiments, the processor may determine that the throwable microphone device is facing down when the processor detects an orientation sensor signal at, above or below a threshold value. In some embodiments, the orientation sensor may be an accelerometer measuring the acceleration with respect to gravity along a single axis. In some embodiments, an average acceleration signal may be compared with respect to gravity. In some embodiments, a peak acceleration value may be compared with respect to gravity. In some embodiments, an instantaneous acceleration value may be compared with respect to gravity. In some embodiments, the throwable microphone device may be determined to be facing down when the accelerometer provides a signal that is calibrated to indicate that the orientation sensor is facing down. For example, if the accelerometer is aligned with the microphone and produces a signal specifying 1 g of acceleration along a given axis then the microphone is facing down.

In some embodiments, the processor may determine that the throwable microphone device is in the still state when the processor receives a motion sensor signal and detects the motion or average motion of the throwable microphone device is less than a threshold value based on the motion sensor signal. In some embodiments, the throwable microphone device may be determined to be in the still state when the motion or average motion of the throwable microphone device is less than a threshold value for a period of time. For example, the period of time may include one (1), two (2), five (5), ten (10), twenty (20) seconds or any other period of time. Block 604 may be followed by block 602 if it is determined that the microphone is not facing down and/or the transmitter is not in the still state ("No" at block 604) or by block 606 if it is determined that the throwable microphone device is facing down and in the still state ("Yes" at block 604).

At block 606, in response to determining the throwable microphone device is facing down and in the still state, the transmitter may be changed to the muted state. In some embodiments, on determining that the throwable microphone device is facing down and in the still state, the throwable microphone device may enter a standby mode, when the throwable microphone device enters the muted state. In some other embodiments, the throwable microphone device may get automatically muted on determining that the throwable microphone device is facing down and in the still state, such that battery life of the throwable microphone device is extended. In some other embodiments, muting of the throwable microphone device may include turning the throwable microphone device to a sleep or standby mode, wherein the throwable microphone device uses minimum power. In some embodiments, the muting of the throwable microphone device may include turning the throwable microphone device to a hibernate mode, wherein the throwable microphone device may use zero power. Block 606 may be followed by block 608.

In some embodiments, muting the throwable microphone device may comprise switching "off" of a microphone, within the throwable microphone device, wherein the microphone may not receive any sound waves, and a communication unit within the throwable microphone device, may not transmit any audio signals. In some embodiments, muting of the throwable microphone device may include a state of the throwable microphone device, wherein the microphone within the throwable microphone device may receive the sound waves but may not transmit the corresponding electrical audio signal. In some embodiments, muting of the throwable microphone device may include a state of the throwable microphone device, wherein the microphone within the throwable microphone device may not receive the sound waves. In some embodiments, the switching "off" of the throwable microphone device may be analogous to switching off the power button on the throwable microphone device.

In some embodiments, muting the throwable microphone device may comprise not transmitting the electrical audio signals from the transmitter. In some embodiments, the throwable microphone device may receive the sound waves, and may convert the sound waves into electrical audio signals, but may not transmit the electrical audio signals from the transmitter, while in the muted state. In some embodiments, the throwable microphone device may store the electrical audio signals in a memory till the phone stays in a muted state.

In some embodiments, muting the throwable microphone device may comprise transmitting a mute signal from the transmitter. In some embodiments, the throwable microphone device may receive the sound waves, but a processor disposed within the throwable microphone device, may only transmit a low energy level signal, and may not send the electrical audio signal.

At block 608, one or more sensor signals may be received at the processor from the sensor. For example, an orientation sensor signal may be received. Block 608 may be followed by block 610.

At block 610 it may be determined whether the microphone is facing upward. In some embodiments, it may be determined that the microphone is facing upward in response to receipt of an orientation sensor signal from an orientation sensor that indicates the microphone is facing upward. In some embodiments, the orientation sensor may be an accelerometer measuring the acceleration with respect to gravity along a single axis. In some embodiments, the acceleration may be opposite to the direction of the acceleration measured when the throwable microphone device is facing downward. In some embodiments, an average acceleration signal may be compared with respect to gravity. In some embodiments, a peak acceleration value may be compared with respect to gravity. In some embodiments, an instantaneous acceleration value may be compared with respect to gravity. In some embodiments, it may be determined that the microphone is facing upward when the microphone is facing in the upward direction for a period of time. In some embodiments, the period of time may be a fraction of one (1) second, one (1) second, two (2) seconds, or any other period of time. Block 610 may be followed by block 612 in response to a determination that the microphone is facing upward ("Yes" at block 610 ") or by block 608 in response to a determination that the microphone is not facing upward ("No" at block 610).

At block 612, in response to determining the microphone is facing upward, the throwable microphone device may be changed to an unmuted state. In some embodiments, the throwable microphone device may be changed to the unmuted state upon shaking of the throwable microphone device, after the throwable microphone device has been in a still state for a period of time. In some embodiments, the period of time may be a fraction of one (1) second, one (1) second, two (2) seconds, or any other period of time. In some embodiments, the shaking of the throwable microphone device may be determined when the motion sensor may send a signal to a processor and the processor may analyze an acceleration value based on the motion sensor signal. In some embodiments, when the acceleration value may exceed a threshold, the throwable microphone device may be unmuted. In some embodiments, unmuting of the throwable microphone device may include switching 'on' of the throwable microphone device from an 'off' state. In some embodiments, unmuting of the throwable microphone device may include switching 'on' of the throwable microphone device from a sleep state or a hibernate state. In some embodiments, unmuting of the throwable microphone device may include receiving the sound waves into the microphone and transmitting the corresponding electrical audio signals to a receiver unit. Block 612 may be followed by block 602.

In some embodiments, unmuting the throwable microphone device may comprise switching "on" of the microphone. In some embodiments, unmuting of the throwable microphone device may include a state of the throwable microphone device, wherein the microphone within the throwable microphone device may receive the sound waves and may transmit the corresponding electrical audio signal. In some embodiments, the switching "on" of the throwable microphone device may be analogous to switching on the power button on the throwable microphone device.

In some embodiments, unmuting the throwable microphone device may comprise re-transmitting the electrical audio signals from the transmitter. In some embodiments, the throwable microphone device may receive the sound waves, and may convert the sound waves into electrical audio signals and may store them in a memory till the throwable microphone device is in a muted state. In some embodiments, in the unmuted state, the stored electrical audio signals may be transmitted. In some other embodiments, the throwable microphone device may just start transmitting electrical audio signals of currently received sound waves.

In some embodiments, unmuting the throwable microphone device may comprise transmitting an unmute signal from the transmitter. In some embodiments, the throwable microphone device may transmit a high energy level signal, while in other embodiments, the throwable microphone device may start sending electrical audio signals of the sound waves being received.

Each of the various blocks (or steps) illustrated in FIG. 6 may or may not be present. For example, one or more blocks may be skipped or may not be executed. In some embodiments, additional blocks may be implemented.

Figure 7:
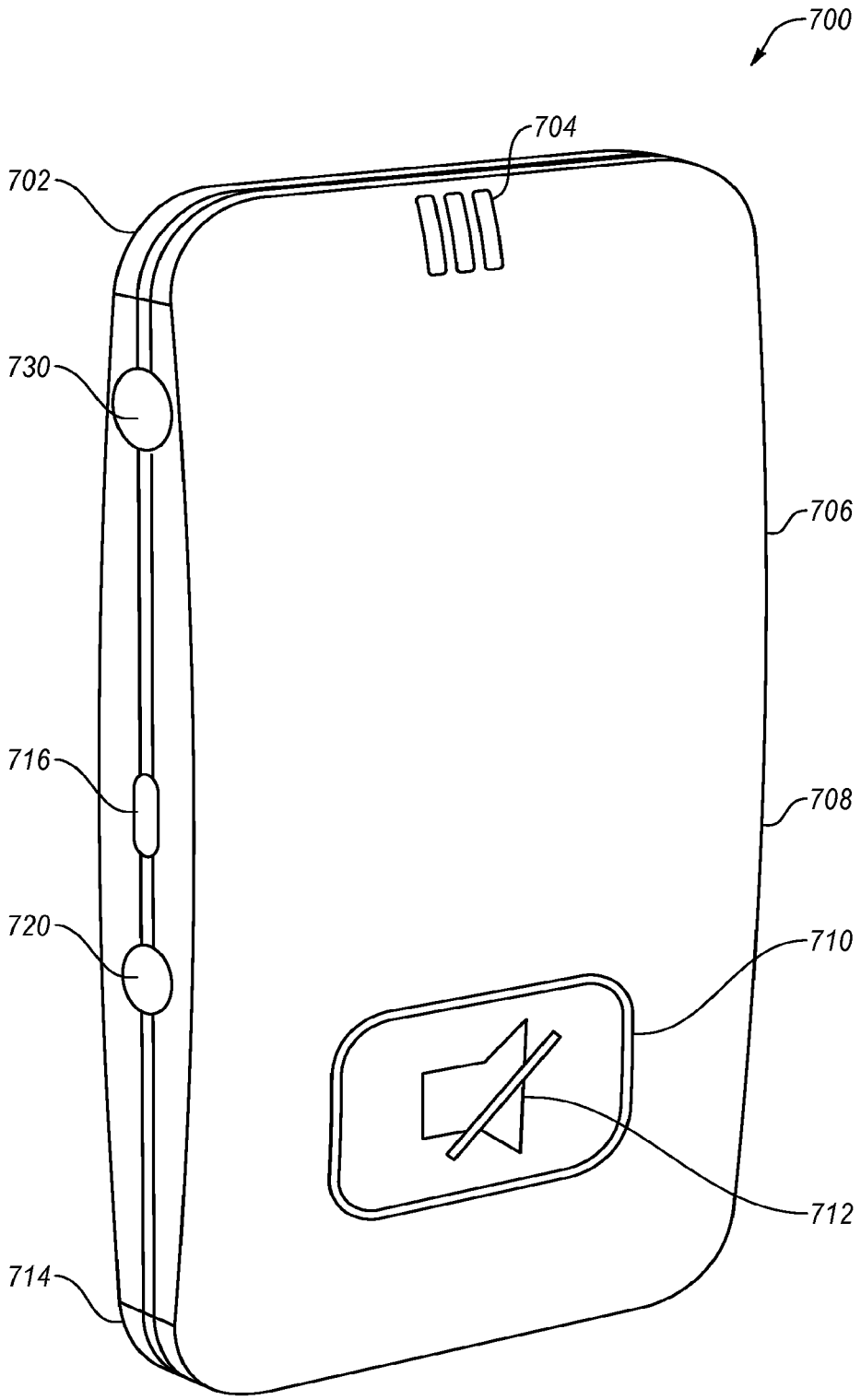
FIG. 7 is a perspective view of another example of a transmitter device of a throwable microphone device.

FIG. 7 is a perspective view of an example throwable microphone device 700. In some embodiments, the throwable microphone device 700 may correspond to the throwable microphone device 102 of FIG. 1 or the throwable microphone device 200 of FIG. 2. In some embodiments, the throwable microphone device may include one or more of the following: a removable lapel clip 702, a microphone 704, a volume button 706, a high power-low power switch 708, one or more status lights 710, a mute button 712, contacts 714 for a charging dock, a USB port 716, a microphone port 720, and a power button 730.

In some embodiments, the throwable microphone device 700 may be worn by a user. In some embodiments, the throwable microphone device 700 may be worn around a body part of the user. For example, the throwable microphone device 700 may be worn around the user's neck. In some embodiments, the throwable microphone device 700 may be worn as a pendant, lanyard, or necklace. In some embodiments, the throwable microphone device 700 may be coupled to the user with the removable lapel clip 702. In some embodiments, the throwable microphone device 700 may be inserted in a throwable microphone device.

In some embodiments, the microphone 704 may be used to detect and receive audio signals, which may be transmitted to a processor in a microcontroller unit. In some embodiments, the volume button 706 may be used to increase and/or decrease the volume of the audio signal received.

In some embodiments, the high power-low power switch 708 may be used to switch the throwable microphone device 700 from a high power state to a low power state or from a low power state to a high power state.

In some embodiments, one or more status lights 710 may indicate whether the throwable microphone device 700 is powered on or off. In some embodiments, the status lights 710 may indicate whether the throwable microphone device 700 is in the mute state of communication or the unmute state of communication. In some embodiments, the status lights 710 may include LED lights.

In some embodiments, the mute button 712 may allow a user to manually mute or unmute the throwable microphone device 700. In some embodiments, the throwable microphone device 700 may also include a power button which may enable the user to manually turn the throwable microphone device 700 on or off In some embodiments, the USB port 716 may be used to provide power and programming to the throwable microphone device 700. In some embodiments, another type of port may be used to provide power and programming to the throwable microphone device 700. In some embodiments, an external microphone may be coupled to the throwable microphone device using the microphone port 720.

In some embodiments, the power button 730 may be used to turn the throwable microphone device 700 'on/off'. In some embodiments, the throwable microphone device 700 may include a lanyard hole.

Figure 8:
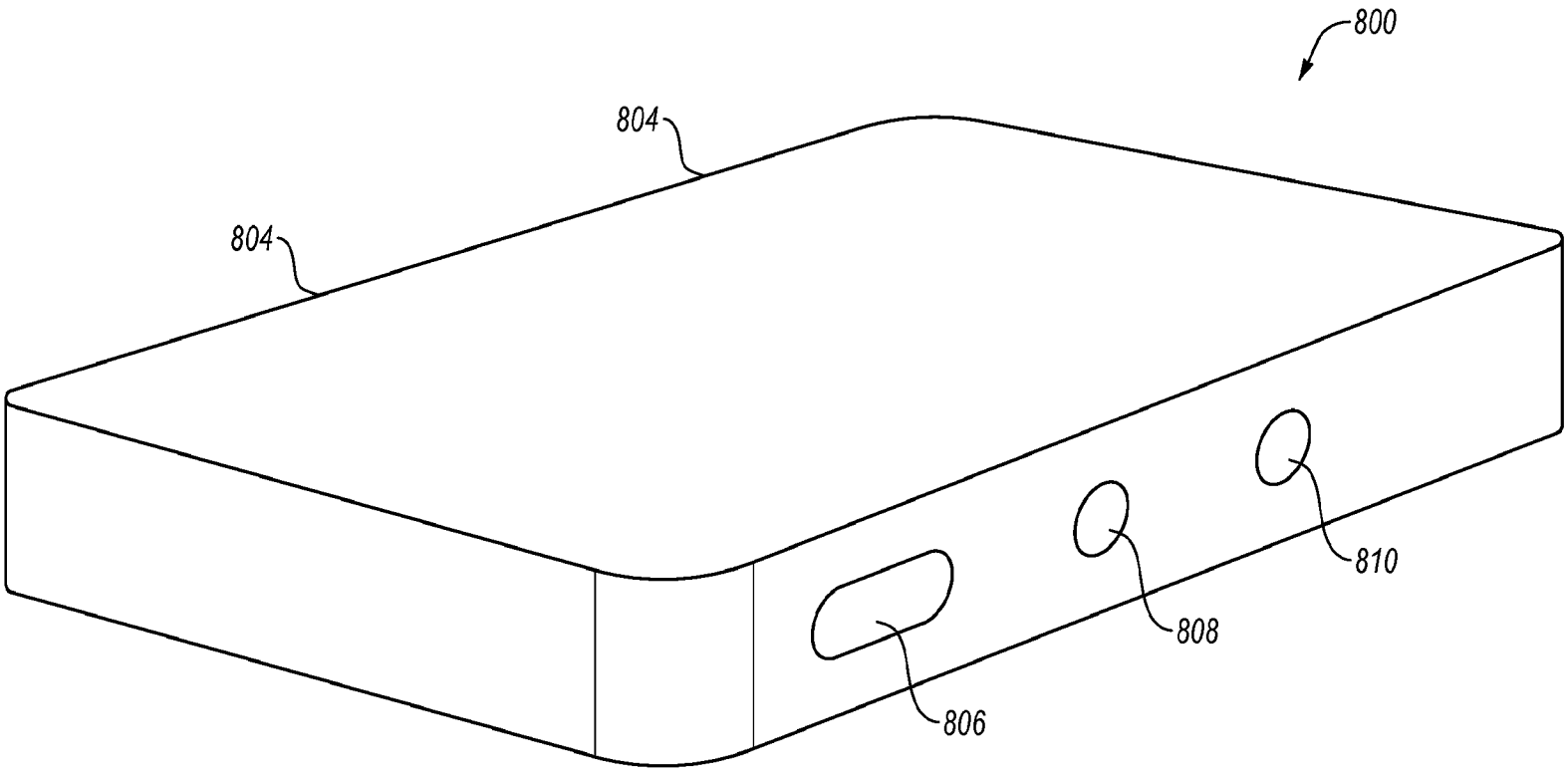
FIG. 8 is a perspective view of an example of a receiver device.

FIG. 8 is a perspective view of an example receiver device 800. In some embodiments, the receiver device 800 may include one or more status lights 802, a power button 804, a USB port 806, an input port 808, and an output port 810.

In some embodiments, the status lights 802 may indicate whether the receiver device 800 is powered on or off In some embodiments, the status lights 802 may indicate whether a throwable microphone device is in the mute state of communication or the unmute state of communication. In some embodiments, the power button 804 may be sued to turn the receiver device 800 'on/off'.

In some embodiments, the USB port 806 may be used to provide power and programming to the receiver device 800. In some embodiments, another type of port may be used to provide power and programming to the receiver device 800.

In some embodiments, the input port 808 may allow the user to connect an audio playback source, such as a smart phone or a computer. In some embodiments, audio received from a microphone on a throwable microphone device may be mixed with audio from the audio playback source. In some embodiments, the output port 810 may be used to couple the receiver device 800 to speakers or another sound amplifying device. In some embodiments, the receiver device 800 may be connected to an existing audio system using the output port 810. For example, the receiver device 800 may be connected to a home theater, a car stereo, a portable speaker, an amplifier, a professional mixing board or any other audio system. In some embodiments, the input port 808 and the output port 810 may be any suitable size, such as, for example, 3.5 millimeters.

Figure 9:
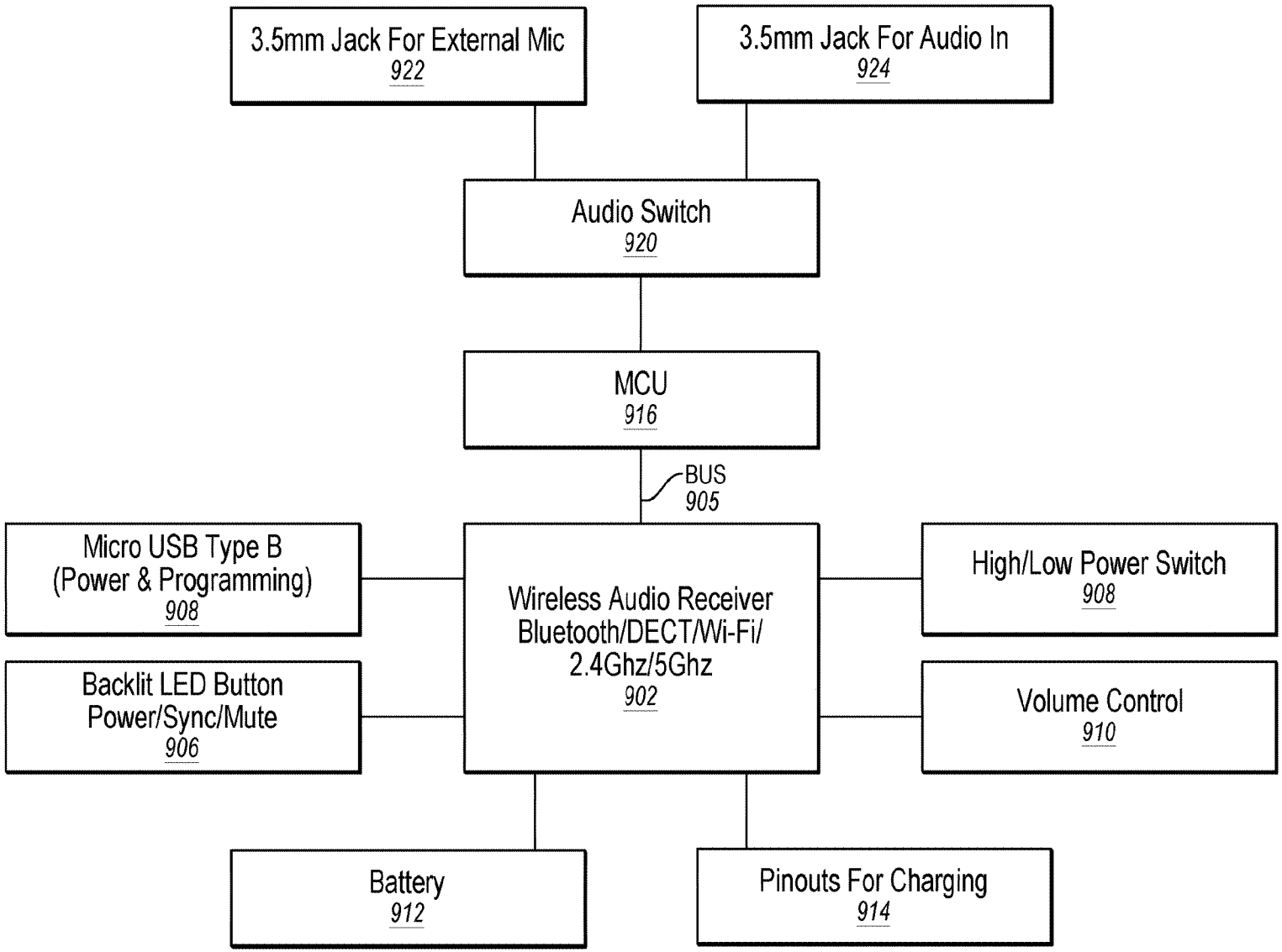
FIG. 9 is block diagram illustrating an example transmitter-receiver system that may be used in conjunction with a throwable microphone device.

FIG. 9 is block diagram illustrating an example transmitter-receiver system 900. In some embodiments, the transmitter-receiver system may include a wireless audio receiver 902, further comprising a micro USB port 904, a backlit LED button 906, a power switch 908, a volume control button 910, a battery 912, and pinouts 914 for charging; a microcontroller unit (MCU) 916, that may receive signals from position and motion sensors 918; an audio switch 920, further comprising a first 3.5 mm jack 922 for external mic, and a second 3.5 mm jack 924 for audio input. The components within the transmitter-receiver system 900 can be electrically coupled via a bus 905 (or may otherwise be in communication, as appropriate).

In some embodiments, the wireless audio receiver 902 may utilize Bluetooth for receiving audio signals, utilizing radio signals in the 2.4 GHz range. In some embodiments, the 2.4 GHz range may be used for data transfer over a short distance. In some other embodiments, Wi-Fi may be used to receive the audio signals from an audio source, utilizing a 2.4 GHz LAN and/or a 5 GHz LAN. In some embodiments, WiMAX may be used. In some other embodiments, DECT radio technology may be used for receiving audio and/or voice data signals. In some other embodiments, ZigBee wireless mesh network may be used for receiving and transmitting audio signals. In some embodiments, other IEEE 802 standards of wireless communication may be used. In some other embodiments, Ethernet cable connections may be used to connect the transmitter-receiver system 902 to other devices.

In some embodiments, a micro USB type-B port 904 may be present in the wireless audio receiver 902. In some embodiments, the USB type-B port 904 may be used to provide power and programming to the wireless audio receiver 902. In some other embodiments, another type of port may be used to provide power and programming to the wireless audio receiver 902. In some embodiments, the micro USB type-B port 904 may include or correspond to the USB port 716 of FIG. 7 or, the USB port 806 of FIG. 8.

In some embodiments, the backlit LED buttons 906 may be used to indicate different modes of operating of the transmitter-receiver system. In some embodiments, one or more backlit LED buttons 906 may indicate whether the throwable microphone device is powered on or off. In some embodiments, the backlit LED buttons 906 may indicate whether the throwable microphone device is in the muted state of communication or the unmuted state of communication. In some embodiments, the backlit LED buttons 906 may indicate whether the system has been authenticated properly and/or whether the audio signal is streaming properly. In some embodiments, the backlit LED buttons 906 may include or correspond to the status lights 710 of FIG. 7, or the status lights 802 of FIG. 8.

In some embodiments, the high/low power switch 908 may be used to allow the user to limit the RF range of the wireless audio receiver. In some embodiments, the high power/low power switch 908 may be used to switch the throwable microphone device from a high power state to a low power state or from a low power state to a high power state. In some embodiments, the high/low power switch 908 may include or correspond to the high power-low power switch 708 of FIG. 7.

In some embodiments, the volume control button 910 may be used to control the volume of the device. In some embodiments, the volume control button 910 may include or correspond to the volume button 706 of FIG. 7.

In some embodiments, the battery 912 may last for four to five hours. In some embodiments, the battery 912 may last for three to four hours. In some other embodiments, the battery 912 may last for five to six hours, etc. In some embodiments, the battery 912 may be rechargeable.

In some embodiments, the pinouts 914 for charging cradle may be used to provide a wired external mode of charging the transmitter-receiver system, for example, to connect to an AC electrical outlet, in case the battery 912 dies. In some embodiments, the pinouts 914 for charging cradle may include or correspond to the contacts 714 for a charging dock of FIG. 7.

In some embodiments, the microcontroller (MCU) 916 may be used to control the functionalities of the transmitter-receiver system 900. In some embodiments, the MCU 904 may include a processor. In some embodiments, the processor may analyze the signals received form the position and motion sensors 918. In some embodiments, the MCU 904 may include or correspond to the microcontroller unit 206 of FIG. 2.

In some embodiments, the position and motion sensors 918 may include accelerometers and gyroscopes. In some embodiments, the accelerometers may be single axis accelerometers and in some other embodiments, the accelerometers may be multi-axis accelerometers. In some embodiments, the gyroscopes may measure rotational movement about one axis and in some other embodiments, the gyroscopes may measure rotational movement about multiple axes.

In some embodiments, an audio switch 920 may be may be used for wired communication of the transmitter-receiver system. In some embodiments, the audio switch 920 may include a first 3.5 mm jack 922 for connecting to the external mic, and a second 3.5 mm jack 910 for receiving the audio input. In some embodiments, there may be multiple 3.5 mm jacks 908 for audio input, and multiple 3.5 mm jacks 910 for connecting to external mics.

Figure 10:
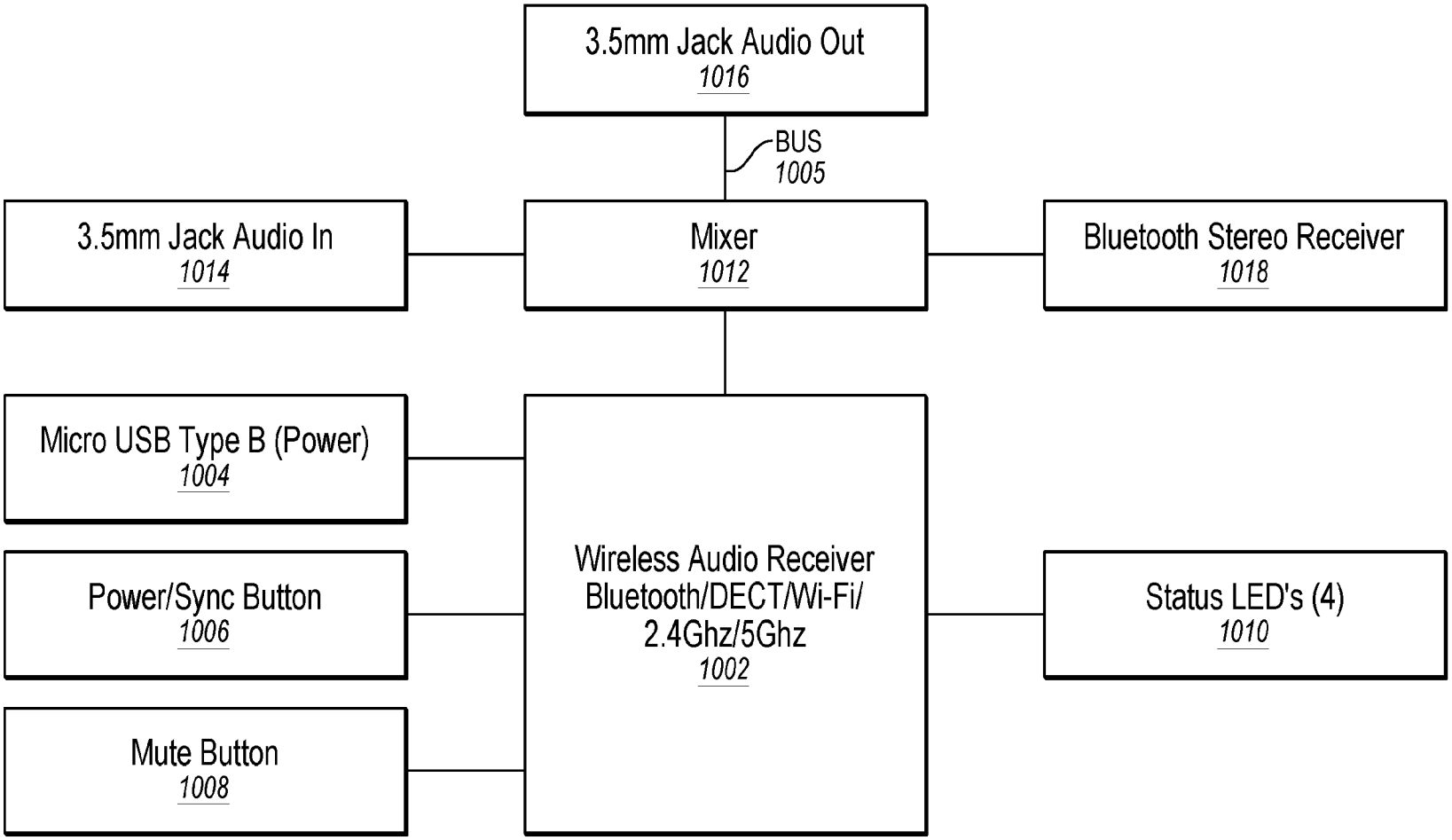
FIG. 10 is a block diagram illustrating another example throwable microphone device.

FIG. 10 is a block diagram illustrating another example transmitter-receiver system 1000. The transmitter-receiver system 1000 may include a wireless audio receiver 1002, further comprising a micro USB type B port 1004, a power/sync button 1006, a mute button 1008, and status LED's 1010; a mixer 1012, further comprising a 3.5 mm jack 1014 for audio input, a 3.5 mm jack 1016 for audio output, and a Bluetooth stereo receiver 1018. The components within the transmitter-receiver system 1000 can be electrically coupled via a bus 1005 (or may otherwise be in communication, as appropriate).

In some embodiments, the wireless audio receiver 1002 may utilize Bluetooth for receiving audio signals, utilizing radio signals in the 2.4 GHz range. In some embodiments, the 2.4 GHz range may be used for data transfer over a short distance. In some other embodiments, Wi-Fi may be used to receive the audio signals from an audio source, utilizing a 2.4 GHz LAN and/or a 5 GHz LAN. In some embodiments, WiMAX may be used. In some other embodiments, DECT radio technology may be used for receiving audio and/or voice data signals. In some other embodiments, ZigBee wireless mesh network may be used for receiving and transmitting audio signals. In some embodiments, other IEEE 802 standards of wireless communication may be used. In some other embodiments, Ethernet cable connections may be used to connect the transmitter-receiver system 902 to other devices.

In some embodiments, a micro USB type-B port 1004 may be present in the wireless audio receiver 902. In some embodiments, the USB type-B port 904 may be used to provide power to the wireless audio receiver 1002. In some other embodiments, another type of port may be used to provide power to the wireless audio receiver 1002. In some embodiments, the micro USB type-B port 1004 may include or correspond to the USB port 716 of FIG. 7 or, the USB port 806 of FIG. 8.

In some embodiments, the power/sync button 1006 may be used to switch the device 'on/off'. In some embodiments, the power/sync button 1006 may be used to analyze whether the system has been authenticated properly and/or whether the audio signal is streaming properly.

In some embodiments, the mute button 1008 may be used to manually mute or unmute the throwable microphone device. In some embodiments, the mute button 1008 may include or correspond to the mute button 712 of FIG. 7.

In some embodiments, the status LED's 1010 may be 4 in number, which may be used to indicate different modes of operating of the transmitter-receiver system. In some embodiments, one or more of the status LED's 1010 may indicate whether the throwable microphone device is powered on or off In some embodiments, the backlit LED buttons 906 may indicate whether the throwable microphone device is in the mute state of communication or the unmute state of communication. In some embodiments, the status LED's 1010 may indicate whether the system has been authenticated properly and/or whether the audio signal is streaming properly. In some embodiments, the status LED's 1010 may include or correspond to the status lights 710 of FIG. 7, or the status lights 802 of FIG. 8.

In some embodiments, the wireless audio receiver 1002 may be connected to the mixer 1012 using a cable. In some embodiments, the wireless audio receiver 1002 may be connected to the mixer 1012 wirelessly. In some embodiments, the mixer 1012 may be used to combine multiple audio signals and modify the dynamics of the audio signals to generate an output audio signal. In some embodiments, the mixer 1012 may include the 3.5 mm jack 1014 for receiving audio input and the 3.5 mm jack 1016 for transmitting audio output. In some embodiments, the output audio signal may be transferred to a Bluetooth stereo receiver 1018.

In some embodiments, the Bluetooth stereo receiver 1018 may be an RF receiver, configured to receive the output audio signal from the mixer 1012. In some embodiments, the Bluetooth stereo receiver 1018 may include an amplifier to amplify the sound of the audio signal.

Figure 11:
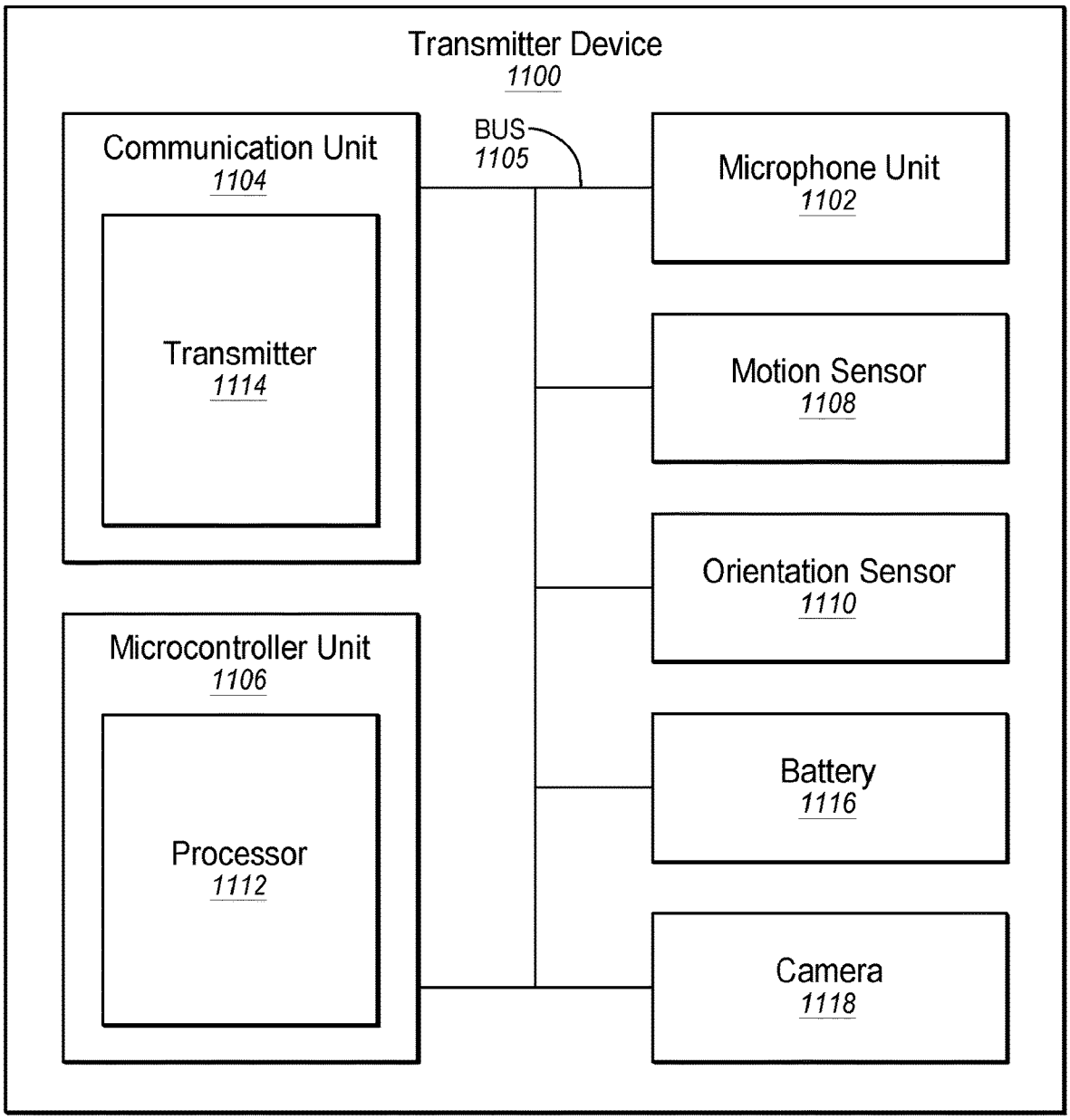
FIG. 11 is a block diagram of an example throwable microphone device.

FIG. 11 illustrates an example throwable microphone device 1100, according to some embodiments. In some embodiments, the throwable microphone device 1100 may include or correspond to the throwable microphone device 102 of FIG. 1. In some embodiments, the throwable microphone device 1100 may include a microphone 1102, a communication unit 1104, a microcontroller unit 1106, a motion sensor 1108, an orientation sensor 1110, a battery 1116, and/or a camera 1118. In some embodiments, the microcontroller unit 1106 may include a processor 1112. In some embodiments, the communication unit 1104 may include a transmitter 1114. In some embodiments, the communication unit 1104 may also include a receiver. In some embodiments, the microcontroller unit 1106 may include a processor 1112. In some embodiments, the microcontroller unit 1106 may also include a memory, a bus architecture, etc. In some embodiments, the battery 1116 may be a non-rechargeable battery, while in some other embodiments, the battery 1116 may be a chargeable battery. In some embodiments, the microphone 1102 may be configured to receive sound waves and produce corresponding electrical audio signals. The components within the throwable microphone device 1100 can be electrically coupled via a bus 1105 (or may otherwise be in communication, as appropriate). In some embodiments, the components within the throwable microphone device 1100 may be directly coupled together without a bus.

In some embodiments, the motion sensor 1108 may include any sensor capable of detecting motion, such as, for example, an accelerometer. In some embodiments, the motion sensor may include any number of axes, such as, for example, three (3) axes. In some embodiments, the motion sensor 1108 may be configured to detect a state of motion of the throwable microphone device 1100 and provide a motion sensor signal responsive to the state of motion. For example, in response to flight of the throwable microphone device 1100, the motion sensor 1108 may provide a motion sensor signal to the processor 1112 that indicates acceleration of the motion sensor 1108. The processor 1112 may determine that the throwable microphone device 1100 has been thrown when the processor 1112 detects an acceleration of the motion sensor 1108 above a threshold value based on the motion sensor signal.

As another example, in response to a tap and/or a double tap on the throwable microphone device 1100, the motion sensor 1108 may provide a motion sensor signal to the processor 1112 that indicates acceleration of the motion sensor 1108. The processor 1112 may determine that the throwable microphone device 1100 has received the tap and/or the double tap when the processor 1112 detects an acceleration of the motion sensor 1108 above a threshold value based on the motion sensor signal.

As a further example, in response to the throwable microphone device 1100 being in a still state, the motion sensor 1108 may provide a motion sensor signal to the processor 1112 that indicates motion or average motion of the motion sensor 1108 is less than a threshold value. The processor 1112 may determine that the throwable microphone device 1100 is in the still state when the processor 1112 detects that the motion or the average motion of the throwable microphone device is less than a threshold value based on the motion sensor signal.

In some embodiments, when the throwable microphone device 1100 is in the still state it may not move for a period of time and/or the motion or average motion of the throwable microphone device 1100 may be less than a threshold value. In some embodiments, the processor 1112 may be configured to receive a motion sensor signal from the motion sensor 1108 and determine the state of motion of the throwable microphone device 1100 based on the motion sensor signal. The state of motion may include, for example, still, a throw, a single tap, or a double tap. In some embodiments, the processor 1112 may be configured to define a particular state of motion based on a value of a motion sensor signal or a range of values of the motion sensor signal.

In some embodiments, the orientation sensor 1110 may include any sensor capable of determining position or orientation, such as, for example, a gyroscope. In some embodiments, the orientation sensor 1110 may include any number of axes, such as, for example, three (3) axes. In some embodiments, the motion sensor 1108 and the orientation sensor 1110 may be combined in a single unit or may be disposed on the same silicon die.

In some embodiments, the orientation sensor 1110 may be configured to detect a position of the microphone 1102 and provide an orientation sensor signal responsive to the position. For example, in response to the microphone 1102 facing upward, the orientation sensor 1110 may provide an orientation sensor signal to the processor 1112. The processor 1112 may determine that the microphone 1102 is facing upward based on the orientation sensor signal. As another example, in response to the throwable microphone device 1100 facing downward, the orientation sensor 1110 may provide a different orientation sensor signal to the processor 1112. The processor 1112 may determine that the microphone 1102 is facing downward based on the orientation sensor signal.

In some embodiments, when the microphone 1102 faces upwards, the throwable microphone device 1100 may also be said to be facing upwards. In some embodiments, when the microphone 1102 faces downwards, the throwable microphone device 1100 may also be said to be facing downwards. Thus, in some embodiments, an orientation sensor signal may indicate the microphone 1102 is facing upward or downward by indicating the throwable microphone device 1100 is facing upward or downward, respectively.

In some embodiments, the processor 1112 may be configured to receive an orientation sensor signal from the orientation sensor 1110 and determine the position of the microphone 1102 based on the orientation sensor signal. In some embodiments, the processor 1112 may be configured to define a particular position based on the orientation sensor signal.

In some embodiments, the microphone 1102 may be disposed in a portion of the throwable microphone device 1100, which may include or correspond to the second portion 106 of the wireless microphone device 100 of FIG. 1. In some embodiments, the microphone 1102 may be disposed at least proximate a flat portion of the throwable microphone device 102, which may correspond to the flat portion 110 of the throwable microphone device 102 of FIG. 1.

In some embodiments, the communication unit 1104 may allow the throwable microphone device 1100 to communicate with a receiver device. In some embodiments, the communication unit 1104 may include a transmitter 1114. In some embodiments, the transmitter 1114 may include an analog radio transmitter. In some embodiments, the transmitter 1114 may communicate digital or analog audio signals over the analog radio. In some embodiments, the transmitter 1114 may wirelessly transmit radio signals to the receiver device. In some embodiments, the transmitter 1114 may include a Bluetooth®, WLAN, Wi-Fi, or other wireless device to send radio signals to the receiver device. In some embodiments, the receiver device may include one or more speakers or may be coupled with one or more speakers In some embodiments, in response to receipt of one or more sensor signals by the processor 1112, the throwable microphone device 1100 may be changed from a muted state to an unmuted state, or alternatively, from the unmuted state to the muted state. In some embodiments, the processor 1112 may be configured to change the state of communication of the transmitter by changing a state of communication of the microphone 1102 and/or the communication unit 1104. For example, the throwable microphone device 1100 may be changed to the muted state by changing the microphone 1102 and/or the communication unit 1104 to the muted state. In some embodiments, the microphone 1102 may be changed to the muted state using a power button on the throwable microphone device 1100 or on the receiver device. In some embodiments, when the throwable microphone device 1100 is in the unmuted state, the throwable microphone device 1100 may send audio to the receiver device via the communication unit 1104. In some embodiments, when the microphone 1102 and the communication unit 1104 are in the unmuted state, the receiver device may receive a signal from the throwable microphone device 1100 to enable sound production.

In some embodiments, the camera 1118 may be configured to record a video and transmit the video to be displayed on a screen. In some embodiments, the camera may be disposed centrally within the throwable microphone device 1100. In some embodiments, the camera 1118 may be disposed proximate to a flat portion of the throwable microphone device 1100. In some embodiments, the flat portion may correspond to the flat portion 110 of the throwable microphone device 100 of FIG. 1. In some embodiments, the camera 1118 may include a lens and a sensor. In some embodiments, the lens may be a collection of glass or plastic elements. In some embodiments, the sensor may use a CCD sensor technology while in some other embodiments, the sensor may use a CMOS sensor technology. In some embodiments, the video may be transmitted to a receiver unit via communication unit 1104 such as, for example, via transmitter 1114. In some embodiments, the lens may be facing the flat portion of the throwable microphone device 1100.

In some embodiments described in this disclosure a microphone (or audio signal) is muted and unmuted (or a throwable microphone device enters a mute or unmute state) based on various sensor inputs and/or characteristics. In some embodiments, video from the camera 1116 (and/or audio from the microphone) may also be muted or unmuted based on various sensor inputs and/or characteristics.

Figure 12:
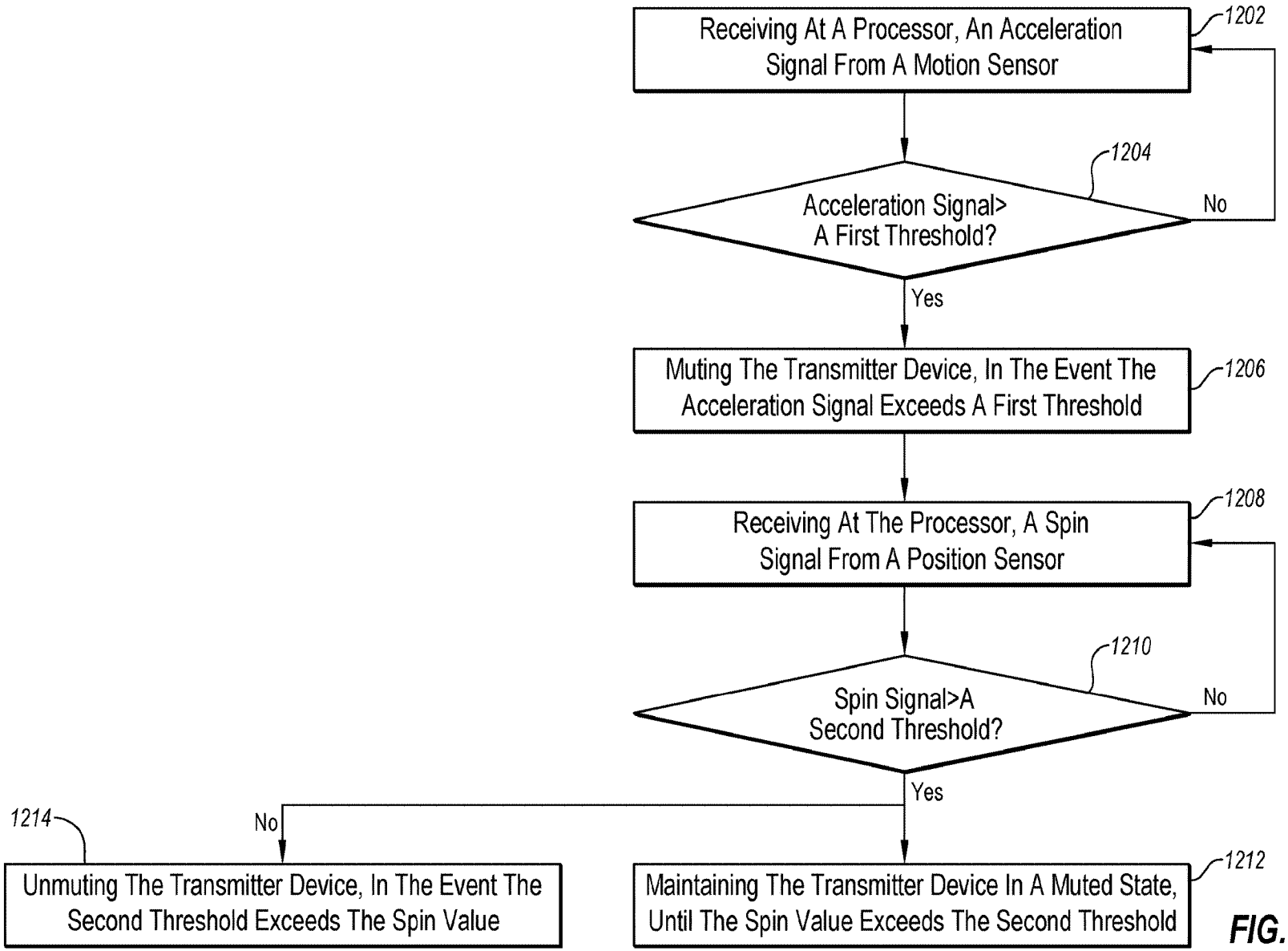
FIG. 12 is a flow chart of an example method of operation of a throwable microphone device.

FIG. 12 is an example flow diagram of a method 1200 of operation of a throwable microphone device. In some embodiments, the throwable microphone device may include or correspond to the throwable microphone device 102 of FIG. 1 or the throwable microphone device 200 of FIG. 2. In some embodiments, the transmitter 1114 may include or correspond to the transmitter 214 of FIG. 2. In some embodiments, the method 1200 may be implemented, in whole or in part, by a processor. The processor may include or correspond to the processor 212 of FIG. 2. The method 1200 may begin at block 1202.

At block 1202, the processor may receive an acceleration signal from a motion sensor. In some embodiments, the motion sensor may include an accelerometer. In some embodiments, the acceleration signal may be generated in response to a throwing action of the throwable microphone device. In some other embodiments, the acceleration signal may be generated in response to a tapping action or a double tapping action. Block 1202 may be followed by block 1204.

At block 1204, it may be determined whether the acceleration signal corresponds with a throwing action. For example, it can be determined that the acceleration signal corresponds with a throwing event if the acceleration signal exceeds a first threshold. In some embodiments, an average acceleration signal may be compared with the first threshold. In some embodiments, a peak acceleration value may be compared with the first threshold. In some embodiments, an acceleration profile or curve may be compared with a threshold profile or curve. In some embodiments, an instantaneous acceleration value may be compared with the first threshold. In the event the acceleration signal is greater than the first threshold, block 1204 may be followed by to block 1206. And in the event the acceleration signal is lesser than the first threshold, block 1204 may be followed by block 1202, and a new acceleration signal may be received.

In some embodiments, the first threshold may be pre-set or may be provided by the user. In some embodiments, the acceleration signal may be needed to exceed the first threshold for a certain period of time. In some embodiments, the period of time may be a fraction of one (1) second, one (1) second, two (2) seconds, or any other period of time.

At block 1206, the throwable microphone device may be muted if the acceleration signal exceeds the first threshold. In some embodiments, muting of the throwable microphone device may include switching 'off' of the throwable microphone device. In some other embodiments, muting of the throwable microphone device may include turning the throwable microphone device to a sleep or standby mode, wherein the throwable microphone device uses minimum power. In some embodiments, the muting of the throwable microphone device may include turning the throwable microphone device to a hibernate mode, wherein the throwable microphone device may use zero power. In some embodiments, muting of the throwable microphone device may include a state of the throwable microphone device, wherein the microphone within the throwable microphone device may receive the sound waves but may not transmit the corresponding electrical audio signal. In some embodiments, muting of the throwable microphone device may include a state of the throwable microphone device, wherein the microphone within the throwable microphone device may not receive the sound waves. Block 1206 may be followed by block 1208.

In some embodiments, muting the throwable microphone device may comprise switching "off" of a microphone, within the throwable microphone device, wherein the microphone may not receive any sound waves, and a communication unit within the throwable microphone device, may not transmit any audio signals. In some embodiments, muting of the throwable microphone device may include a state of the throwable microphone device, wherein the microphone within the throwable microphone device may receive the sound waves but may not transmit the corresponding electrical audio signal. In some embodiments, muting of the throwable microphone device may include a state of the throwable microphone device, wherein the microphone within the throwable microphone device may not receive the sound waves. In some embodiments, the switching "off" of the throwable microphone device may be analogous to switching off the power button on the throwable microphone device.

In some embodiments, muting the throwable microphone device may comprise not transmitting the electrical audio signals from the transmitter. In some embodiments, the throwable microphone device may receive the sound waves, and may convert the sound waves into electrical audio signals, but may not transmit the electrical audio signals from the transmitter, while in the muted state. In some embodiments, the throwable microphone device may store the electrical audio signals in a memory till the phone stays in a muted state.

In some embodiments, muting the throwable microphone device may comprise transmitting a mute signal from the transmitter. In some embodiments, the throwable microphone device may receive the sound waves, but a processor disposed within the throwable microphone device, may only transmit a low energy level signal, and may not send the electrical audio signal.

At block 1208, the processor may receive a spin signal from an orientation sensor such as, for example, a gyroscope. In some embodiments, the spin value may be in reference to a reference plane. Block 1208 may be followed by block 1210.

In some embodiments, the spin signal may be represented based on the orientation of the throwable microphone device along a rotational axis, and wherein the spin signal may also be determined based on the presence or absence of a rotational force on the throwable microphone device.

At block 1210 it may be determined whether the spin signal received from the orientation sensor is greater than a second threshold value. In some embodiments, block 1210 may be followed by block 1212, when the spin signal is greater than the second threshold, and block 1210 may be followed by block 1214, when the spin value is lesser than the second threshold. In some embodiments, an average acceleration signal may be compared with the second threshold. In some embodiments, a peak acceleration value may be compared with the second threshold. In some embodiments, an acceleration profile or curve may be compared with a threshold profile or curve. In some embodiments, an instantaneous acceleration value may be compared with the second threshold. In the event the spin signal is greater than the second threshold, block 1210 may be followed by to block 1212. And in the event the spin signal is lesser than the second threshold, block 1210 may be followed by block 1208, and a new spin signal may be received.

At block 1212, the throwable microphone device may be maintained in a muted state, until the spin value exceeds the second threshold. In some embodiments, the second threshold value may be pre-set or may be provided by the user in real-time. In some embodiments, the spin value may be needed to exceed the second threshold for a certain period of time. In some embodiments, the period of time may be a fraction of one (1) second, one (1) second, two (2) seconds, or any other period of time. In some embodiments, the period of time may be pre-set or may be provided by the user in real-time.

At block 1214, the throwable microphone device may be unmuted when the spin value is less than the second threshold value, which may, for example, indicate that the throwable microphone device is no longer spinning and, therefore, likely caught by an individual. In some embodiments, the second threshold may exceed the spin value for a certain given period of time. In some embodiments, the period of time may be a fraction of one (1) second, one (1) second, two (2) seconds, or any other period of time. In some embodiments, the period of time may be pre-set or may be provided by the user in real-time. In some embodiments, unmuting of the throwable microphone device may include switching 'on' of the throwable microphone device from an 'off' state. In some embodiments, unmuting of the throwable microphone device may include switching 'on' of the throwable microphone device from a sleep state or a hibernate state. In some embodiments, unmuting of the throwable microphone device may include receiving the sound waves into the microphone and transmitting the corresponding electrical audio signals to a receiver unit.

In some embodiments, unmuting the throwable microphone device may comprise switching "on" of the microphone. In some embodiments, unmuting of the throwable microphone device may include a state of the throwable microphone device, wherein the microphone within the throwable microphone device may receive the sound waves and may transmit the corresponding electrical audio signal. In some embodiments, the switching "on" of the throwable microphone device may be analogous to switching on the power button on the throwable microphone device.

In some embodiments, unmuting the throwable microphone device may comprise re-transmitting the electrical audio signals from the transmitter. In some embodiments, the throwable microphone device may receive the sound waves, and may convert the sound waves into electrical audio signals and may store them in a memory till the throwable microphone device is in a muted state. In some embodiments, in the unmuted state, the stored electrical audio signals may be transmitted. In some other embodiments, the throwable microphone device may just start transmitting electrical audio signals of currently received sound waves.

In some embodiments, unmuting the throwable microphone device may comprise transmitting an unmute signal from the transmitter. In some embodiments, the throwable microphone device may transmit a high energy level signal, while in other embodiments, the throwable microphone device may start sending electrical audio signals of the sound waves being received.

Each of the various blocks (or steps) illustrated in FIG. 12 may or may not be present. For example, one or more blocks may be skipped or may not be executed. In some embodiments, additional blocks may be implemented.

The term "substantially" means within 5% or 10% of the value referred to or within manufacturing tolerances.

Various embodiments are disclosed. The various embodiments may be partially or completely combined to produce other embodiments.

Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter.

Some portions are presented in terms of algorithms or symbolic representations of operations on data bits or binary digital signals stored within a computing system memory, such as a computer memory. These algorithmic descriptions or representations are examples of techniques used by those of ordinary skill in the data processing art to convey the substance of their work to others skilled in the art. An algorithm is a self-consistent sequence of operations or similar processing leading to a desired result. In this context, operations or processing involves physical manipulation of physical quantities. Typically, although not necessarily, such quantities may take the form of electrical or magnetic signals capable of being stored, transferred, combined, compared, or otherwise manipulated. It has proven convenient at times, principally for reasons of common usage, to refer to such signals as bits, data, values, elements, symbols, characters, terms, numbers, numerals, or the like. It should be understood, however, that all of these and similar terms are to be associated with appropriate physical quantities and are merely convenient labels. Unless specifically stated otherwise, it is appreciated that throughout this specification discussions utilizing terms such as "processing," "computing," "calculating," "determining," and "identifying" or the like refer to actions or processes of a computing device, such as one or more computers or a similar electronic computing device or devices, that manipulate or transform data represented as physical, electronic, or magnetic quantities within memories, registers, or other information storage devices, transmission devices, or display devices of the computing platform.

The system or systems discussed herein are not limited to any particular hardware architecture or configuration. A computing device can include any suitable arrangement of components that provides a result conditioned on one or more inputs. Suitable computing devices include multipurpose microprocessor-based computer systems accessing stored software that programs or configures the computing system from a general-purpose computing apparatus to a specialized computing apparatus implementing one or more embodiments of the present subject matter. Any suitable programming, scripting, or other type of language or combinations of languages may be used to implement the teachings contained herein in software to be used in programming or configuring a computing device.

Embodiments of the methods disclosed herein may be performed in the operation of such computing devices. The order of the blocks presented in the examples above can be varied—for example, blocks can be re-ordered, combined, and/or broken into sub-blocks. Certain blocks or processes can be performed in parallel.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, it should be understood that the present disclosure has been presented for-purposes of example rather than limitation, and does not preclude inclusion of such modifications, variations, and/or additions to the present subject matter as would be readily apparent to one of ordinary skill in the art.

That which is claimed:

1. A throwable microphone device comprising:

a housing having an external surface, the external surface having a spherical shape with a single flat portion, wherein the flat portion is sized and configured to ensure the throwable microphone is situated stably on a flat surface when the flat portion is facing downward;

a microphone disposed in the housing proximate to the flat portion that receives sound waves and generate a corresponding electrical audio signal;

a communication unit disposed in the housing, the communication unit comprising a transmitter that wirelessly transmits at least a portion of the electrical audio signals;

an orientation sensor disposed in the housing, that detects the orientation of the throwable microphone relative to the flat portion of the housing and generates an orientation sensor signal based on the orientation of the throwable microphone, and a processor disposed in the housing and electrically coupled with the microphone, the communication unit, and the orientation sensor, the processor mutes the throwable microphone device in response to the orientation sensor signal indicating the flat portion of the housing faces downward, and unmutes the throwable microphone device in response to the orientation sensor signal indicating the flat portion of the housing does not face downward.

2. The throwable microphone device of claim 1, wherein the processor is further configured to unmute the throwable microphone device in response to data from the orientation sensor indicating the flat portion of the housing faces upward.

3. The throwable microphone device of claim 1, wherein the housing comprises at least one material selected from the group consisting of soft shell, foam, fleece, polyester, cotton, rubber, nylon, leather, and padding.

4. The throwable microphone device of claim 1, wherein the microphone is disposed proximate to the flat portion of the throwable microphone.

5. The throwable microphone device of claim 1, wherein the orientation sensor comprises a gyroscope.

6. The throwable microphone device of claim 1, wherein muting the throwable microphone device comprises switching 'off' the microphone, not transmitting the electrical audio signals from the transmitter, or transmitting a mute signal via the transmitter.

7. The throwable microphone device of claim 1, wherein the microphone is disposed vertically relative to the flat portion of the throwable microphone.

8. A throwable microphone device comprising:

a housing having an external surface, the external surface having a spherical shape with a single flat portion, wherein the flat portion is sized and configured to ensure the throwable microphone is situated stably on a flat surface when the flat portion is facing downward;

a microphone disposed in the housing proximate to the flat portion, configured to receive sound waves and generate a corresponding electrical audio signal;

a communication unit disposed in the housing, the communication unit comprising a transmitter that wirelessly transmits at least a portion of the electrical audio signals;

an orientation sensor disposed in the housing, that detects the orientation of the throwable microphone and generates an orientation sensor signal based on the orientation of the throwable microphone, and a processor disposed in the housing and electrically coupled with the microphone, the communication unit, and the orientation sensor, the processor that unmutes the throwable microphone device in response to the orientation sensor signal indicating the flat portion of the housing faces upward, and mutes the throwable microphone device in response to the orientation sensor signal indicating the flat portion of the housing faces downward.

9. The throwable microphone device of claim 8, wherein the processor is further configured to mute the throwable microphone device in response to data from the orientation sensor indicating the flat portion of the housing faces downward.

10. The throwable microphone device of claim 8, wherein the housing comprises at least one material selected from the group consisting of soft shell, foam, fleece, polyester, cotton, rubber, nylon, leather, and padding.

11. The throwable microphone device of claim 8, wherein the orientation sensor comprises a gyroscope.

12. The throwable microphone device of claim 8, wherein unmuting the throwable microphone device comprises switching 'on' the microphone, transmitting the electrical audio signals from the transmitter, or transmitting an unmute signal via the transmitter.

13. The throwable microphone device of claim 8, wherein the processor is further configured to determine that the throwable microphone device is facing upward for a period of time prior to muting the microphone.

* * * * *